US006047149A

United States Patent [19]

Nishimura et al.

[11] Patent Number: 6,047,149

[45] **Date of Patent: *Apr. 4, 2000**

[54] IMAGE FORMING APPARATUS HAVING A ROTATABLE FIRST DEVELOPING MEMBER, AND A FIXED SECOND DEVELOPING MEMBER HAVING A HOUSING PARTIALLY COVERING THE FIRST DEVELOPING MEMBER

[75] Inventors: Katsuhiko Nishimura, Yokohama; Kimio Nakahata, Kawasaki; Masuo Yamazaki, Yokohama; Masami Takeda, Kawasaki; Hiromichi Yamada, Yokohama; Tatsuya Nakamura, Tokyo; Tohru Saitou, Yokohama; Tohru Kosaka, Machida; Takashi Shibuya; Yasuo Yoda, both of Kawasaki; Masahide Hirai, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/348,221

[22] Filed: Nov. 28, 1994

[30] Foreign Application Priority Data

Nov. 26, 1993 [JP] Japan ..... 5-321181

[51] Int. Cl.[7] ..... G03G 15/01; G03G 21/00

[52] U.S. Cl. ..... 399/98; 399/223; 399/228

[58] Field of Search ..... 355/326 R, 327; 399/54, 223, 228, 334, 98, 99

[56] References Cited

U.S. PATENT DOCUMENTS

| | | | |
|---|---|---|---|
| 4,669,852 | 6/1987 | Tajima et al. | 118/653 |
| 4,766,468 | 8/1988 | Hosono et al. | 118/657 X |
| 4,780,742 | 10/1988 | Takahashi et al. | 430/124 X |
| 4,937,630 | 6/1990 | Yoshikawa et al. | 355/326 |
| 4,958,187 | 9/1990 | Tsuchiya et al. | 355/202 |
| 5,160,969 | 11/1992 | Mizuma et al. | 355/326 R |
| 5,245,387 | 9/1993 | Kubo et al. | 355/327 X |
| 5,281,504 | 1/1994 | Kanbayashi et al. | 430/99 |
| 5,307,147 | 4/1994 | Kumasaka et al. | 355/326 R |
| 5,325,165 | 6/1994 | Ohgita et al. | 355/326 R X |
| 5,500,738 | 3/1996 | Noguchi | 355/326 R X |

FOREIGN PATENT DOCUMENTS 5-241420 9/1993 Japan .

*Primary Examiner*—Fred L. Braun

*Attorney, Agent, or Firm*—Fitzpatrick, Cella Harper & Scinto

[57] ABSTRACT

An image forming apparatus including a rotatable developing member having a plurality of developing devices for developing an image bearing member at a first developing station, and a second single developing device arranged upstream of the rotatable developing member for developing the image bearing member exclusively at a second developing station different from the first developing station. The second developing device has a cover portion covering the rotatable developing member, and a portion of the cover portion is disposed at a position spaced apart from a rotation axis of the rotatable developing member by a predetermined length in a horizontal direction away from the image bearing member. The rotatable developing member rotates in an opposite direction with respect to the direction of rotation of the image bearing member to prevent toner from scattering toward the optical system.

33 Claims, 19 Drawing Sheets

$$SF1 = \frac{(MXLNG)^2}{AREA} \times \frac{\pi}{4} \times 100$$

FIG. 17

【ESTERWAX GENERAL STRUCTURE EQUATION (1)】

$$[R1 - COO - (CH2)n]_a C [(CH2)m - OCO - R2]_b$$

a, b : THEY MEAN INTEGERS ; a + b = 4

$R_1$, $R_2$ : THEY MEAN ORGANIC BASES WHOSE NUMBERS OF CARBON ARE INTEGERS FROM 0 TO 40 ; DIFFERENCE OF CARBON NUMBERS BETWEEN $R_1$ AND $R_2$ IS EQUAL TO OR MORE THAN 10 n, m : THEY MEAN INTEGERS FROM 0 TO 15 ; THEY DO NOT BECOME 0 AT SAME TIME

【ESTERWAX GENERAL STRUCTURE EQUATION (2)】

$$[R1 - COO - (CH2)n]_a C [(CH2)m - OH]_b$$

a, b : THEY MEAN INTEGERS ; a + b = 4

$R_1$ : IT MEANS ORGANIC BASE WHOSE NUMBER OF CARBON IS INTEGER FROM 1 TO 40 n, m : THEY MEAN INTEGERS FROM 0 TO 15 ; THEY DO NOT BECOME 0 AT SAME TIME

【ESTERWAX GENERAL STRUCTURE EQUATION (3)】

$$[R1 - COO - (CH2)n]_a \overset{R3}{\overset{|}{C}} [(CH2)m - OCO - R2]_b$$

a, b : THEY MEAN INTEGERS FROM 0 TO 3 ; a + b ≦ 3

$R_1$, $R_2$ : THEY MEAN ORGANIC BASES WHOSE NUMBERS OF CARBON ARE INTEGERS FROM 0 TO 40; DIFFERENCE OF CARBON NUMBERS BETWEEN $R_1$ AND $R_2$ IS EQUAL TO OR MORE THAN 10

$R_3$ : IT MEANS ORGANIC BASE WHOSE NUMBER OF CARBON IS EQUAL TO OR MORE THAN 1 n, m : THEY MEAN INTEGERS FROM 0 TO 15 ; THEY DO NOT BECOME 0 AT SAME TIME

IMAGE FORMING APPARATUS HAVING A ROTATABLE FIRST DEVELOPING MEMBER, AND A FIXED SECOND DEVELOPING MEMBER HAVING A HOUSING PARTIALLY COVERING THE FIRST DEVELOPING MEMBER

BACKGROUND OF THE INVENTION

1. Field of the Invention

The present invention relates to an image forming apparatus such as a copying machine, a laser beam printer, a facsimile machine and the like, having a rotatable developing means capable of developing an image formed on an image bearing member such as a photosensitive drum.

2. Related Background Art

FIG. 15 is a schematic example of a multi-color image forming apparatus for forming an image by using an intermediate transfer member. The image forming apparatus is a copying machine or a laser beam printer using an electrophotographic process. Now, a construction and operation of such an image forming apparatus will be briefly explained.

(1) An electrophotographic photosensitive body (referred to as "photosensitive drum" hereinafter) 1 of a rotary drum type as an image bearing member is arranged within an interior of the image forming apparatus (referred to as "within the apparatus" hereinafter), which photosensitive drum 1 is rotated at a predetermined peripheral speed (process speed) in a direction shown by the arrow R1, and an image formation process (described later) is repeatedly effected regarding a surface of the photosensitive drum.

When the photosensitive drum 1 is rotated in the direction R1, it is charged with a predetermined polarity and a predetermined surface potential by a charge means 2 such as a corona charger, and then an electrostatic latent image corresponding to a first color image component (for example, a magenta color image component) of a desired color image is formed on the photosensitive drum by effecting image exposure L by an exposure device 3 (image focusing exposure optical system using color decomposition of an original color image, or a scan exposure optical system using a laser scanner for outputting a laser beam modulated in response to an electric time-sequence digital pixel signal of image information).

Thereafter, the electrostatic latent image is developed with a first color (for example, a magenta (M) color toner (coloring charge particles)) by a first developing device (for example, a magenta developing device) 41 of a rotatable developing means 4. An endless intermediate transfer belt (intermediate transfer member) 50 is arranged below and slightly rightwardly of the photosensitive drum 1. The intermediate transfer belt 50 is mounted around and tensioned by one conductive roller 6 and three turn rollers 7*a*, 7*b* and 7*c*. The conductive roller 6 serves to urge the intermediate transfer belt 50 against the photosensitive drum 1 with a predetermined urging force.

The intermediate transfer belt 50 is rotated in a direction shown by the arrow R5 at a peripheral speed that is the same as that of the photosensitive drum 1. A transfer bias having a polarity (plus) opposite to a charging polarity (minus in the illustrated example) of the toner of a toner image formed on the photosensitive drum 1 is applied to the conductive roller 6 by a first bias power source 61. The intermediate transfer belt 50 is formed from a dielectric sheet made of polyester, polyethylene or the like, or a composite dielectric film comprised of middle-resistance rubber a back surface (inner surface) of which is backed by conductive body. The first color or magenta color toner image formed on the photosensitive drum 1 is transferred onto an outer surface of the intermediate transfer belt 50 at a transfer station by an electric field generated by the application of the transfer bias to the conductive roller 6.

On the other hand, after the first magenta color toner image is transferred to the intermediate transfer belt 50, the photosensitive drum 1 is cleaned by a cleaning device 14.

(2) The charging of the photosensitive drum 1, the image exposure L corresponding to a second color component image (for example, a cyan component image), the development with cyan (C) toner by a second developing device (cyan developing device) 42, the transferring of the second cyan toner image onto the intermediate transfer belt 50, and the cleaning of the surface of the photosensitive drum 1 by the cleaning device 14 are effected.

(3) The charging of the photosensitive drum 1, the image exposure L corresponding to a third color component image (for example, an yellow component image), the development with yellow (Y) toner by means of a third developing device (yellow developing device) 43, the transferring of the third yellow toner image onto the intermediate transfer belt 50, and the cleaning of the surface of the photosensitive drum 1 by the cleaning device 14 are effected.

(4) The charging of the photosensitive drum 1, the image exposure L corresponding to a fourth color component image (for example, a black component image), the development with black (BK) toner by a fourth developing device (black developing device) 44, the transferring of the fourth black toner image onto the intermediate transfer belt 50, and the cleaning of the surface of the photosensitive drum 1 by the cleaning device 14 are effected.

By successively performing the above image forming and transferring processes (1)–(4), the four toner images (magenta, cyan, yellow and black toner images) are successively transferred onto the outer surface of the intermediate transfer belt 50 in a superimposed fashion, thereby forming a composite color toner image (mirror image) corresponding to a desired color image.

On the other hand, a transfer material (paper sheet) P is separated and supplied one by one from a sheet supply cassette 9 by a sheet supply roller 10, and the separated transfer sheet P is sent to the transfer station defined by a transfer device (corona charger) 7 and the turn roller 7*a* through a pair of regist rollers 11 and a transfer guide 12 at a predetermined timing. Further, when the toner image is transferred onto the transfer sheet P supplied at the predetermined timing, a transfer bias having a polarity (plus) opposite to a toner charging polarity (minus in the illustrated case) is applied to the transfer device 7 by a third bias power source 71.

By repeating a series of the above-mentioned image forming processes, the color toner images are successively transferred onto the intermediate transfer belt 50, and the transferred color toner images are transferred onto the transfer sheet P supplied to the transfer station. The transfer sheet P to which the toner images were transferred at the transfer station is sent, through a convey guide 13, to a fixing device 15, where the toner images are fused and mixed between a fixing roller 16 and a pressure roller 17 within heat and pressure to form a permanent color image on the transfer sheet. Then, the transfer sheet is discharged out of the image forming apparatus as a color copy.

On the other hand, after the transferring operation, the intermediate transfer belt 50 is cleaned by a belt cleaning device 8. The belt cleaning device 8 is a cleaning device for the intermediate transfer belt 50 and is normally inoperative to the intermediate transfer belt 50. However, after the toner images were transferred onto the transfer sheet P, the belt cleaning device 8 is abutted against the outer surface of the intermediate transfer belt 50, thereby cleaning the outer surface of the intermediate transfer belt 50.

However, in the above-mentioned example, since the rotatable developing means is used as a developing means, the toner is apt to be scattered by the rotation of the developing means, thereby smudging the exposure device 3 and/or the convey guide 13 for the transfer sheet, with the result that the exposure of the photosensitive drum (image bearing member) 1 becomes insufficient and causes poor image formation and/or the transfer sheet is smudged by toner during the conveyance of the transfer sheet.

Incidentally, the Japanese Patent Laid-open No. 5-241420 discloses a technique in which a black developing device is arranged above a rotatable developing means. However, in this case, an exposure device may be smudged by toner.

SUMMARY OF THE INVENTION

An object of the present invention is to provide an image forming apparatus which can suppress the scattering of toner.

Another object of the present invention is to provide an image forming apparatus in which an optical system is not smudged.

A further object of the present invention is to provide an image forming apparatus which can prevent a poor image.

A still further object of the present invention is to provide an image forming apparatus in which a rotatable developing means is covered by another developing device.

The other objects and features of the present invention will be apparent from the following detailed description of the present invention.

BRIEF DESCRIPTION OF THE DRAWINGS

FIG. 17 is a view showing esterwax general structure equations; and

DETAILED DESCRIPTION OF THE PREFERRED EMBODIMENTS

Figure 1:
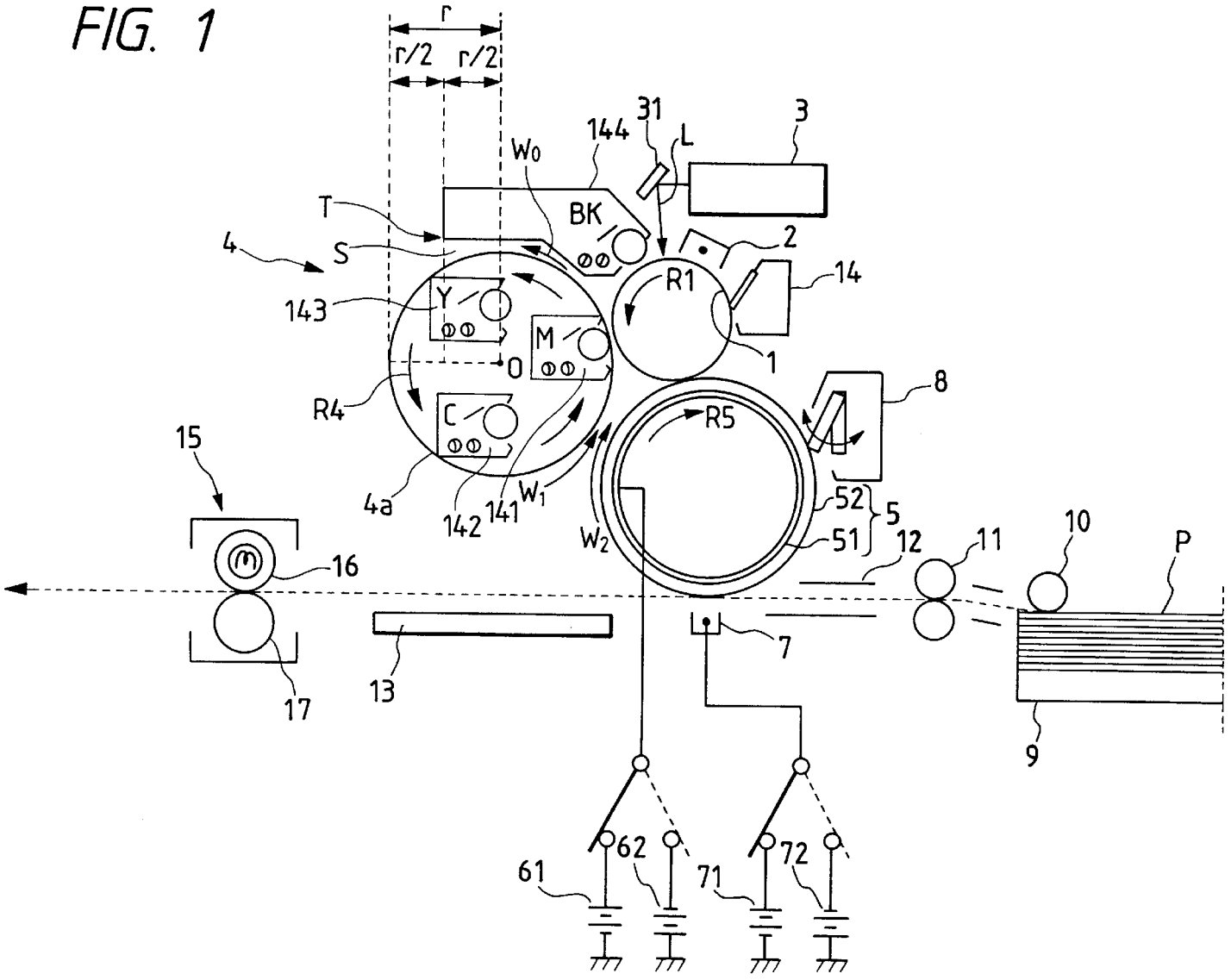
FIG. 1 is a schematic elevational sectional view of a multi-color image forming apparatus according to a first embodiment of the present invention.

The present invention will now be explained in connection with an embodiment thereof with reference to the accompanying drawings. Incidentally, in various Figs. including FIG. 15, the same functional and constructural elements are designated by the same reference numerals and repeated explanation thereof will be omitted.

First Embodiment

FIG. 1 is a schematic elevational sectional view of an image forming apparatus according to a first embodiment of the present invention. This embodiment is the same as the example shown in FIG. 15 in the point that the charge device 2 and exposure device 3 are arranged around the photosensitive drum 1, but greatly differs from the example of FIG. 15 regarding a developing means and an intermediate transfer member. Incidentally, in FIG. 1, regarding the exposure device 3, a reflection mirror 31 is shown independently from the exposure device 3 to explain the advantage of the present invention more clearly.

Figure 15:
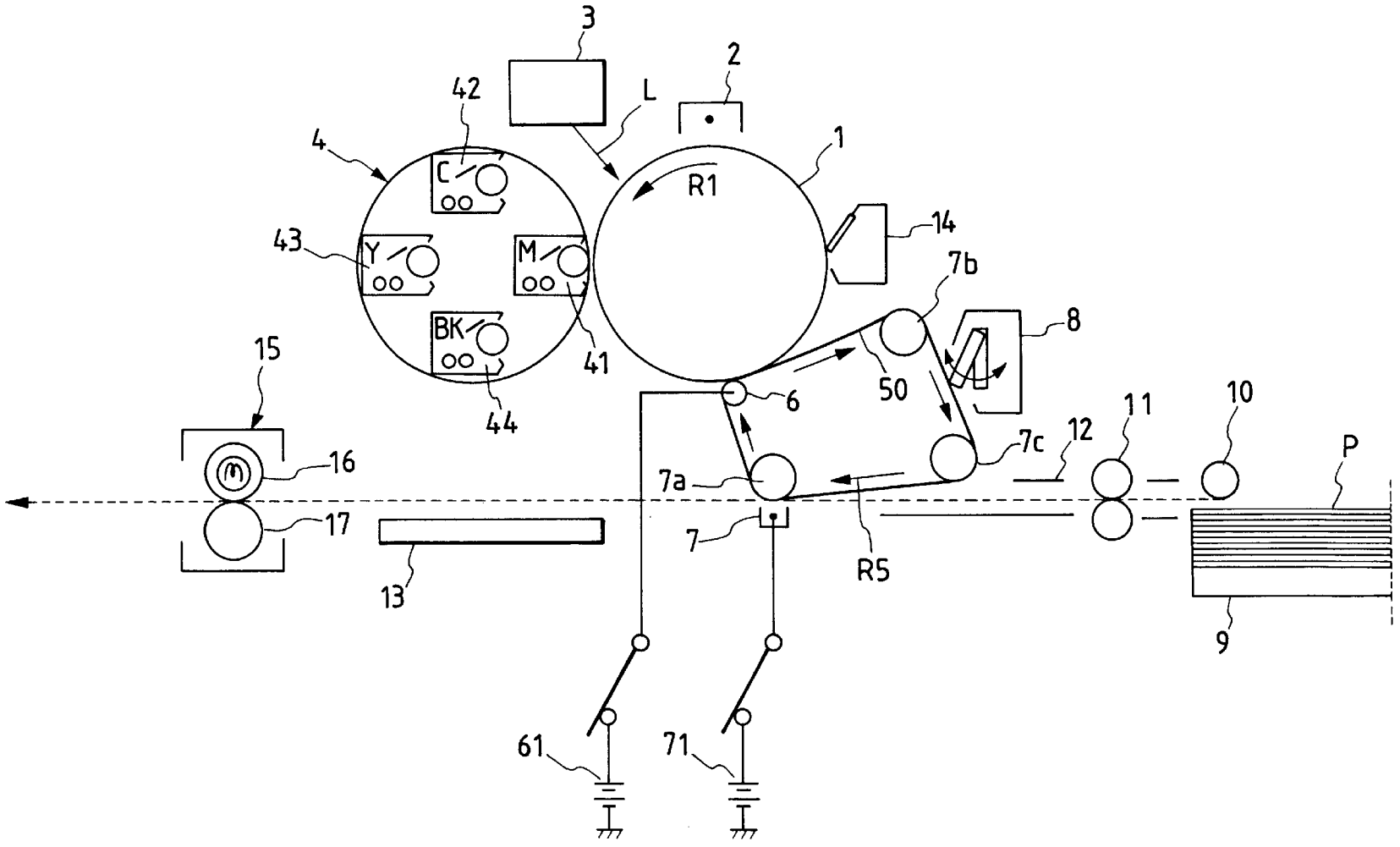
FIG. 15 is a schematic elevational sectional view of a multi-color image forming apparatus comparable with the present invention.

In this embodiment, in place of the intermediate transfer belt 50 in FIG. 15, an intermediate transfer drum 5 is used as an intermediate transfer member. The intermediate transfer drum 5 is constituted by a hollow conductive metal cylinder 51, and an intermediate transfer layer 52 formed from polyethylene film or polyester film and coated on an outer surface of the cylinder. The transfer drum is abutted against the photosensitive drum 1 from below and is rotated in a direction shown by the arrow R5. The hollow cylinder 51 and the intermediate transfer layer 52 are disposed on the whole area where the toner image can be formed. A first bias power source 61 and a second bias power source 62 are connected to the hollow cylinder 51 of the intermediate transfer drum 5, and a third bias power source 71 and a fourth bias power source 72 are connected to the transfer device 7 arranged below the intermediate transfer drum 5.

The entire developing means comprises a stationary developing means including a black (BK) developing device (referred to as "BK developing device" hereinafter) 144 fixedly arranged at an upstream side of the photosensitive drum 1 in a rotational direction thereof (direction shown by the arrow R1), and a rotatable developing means 4 rotatably arranged at a downstream side and including three other color developing devices. The rotatable developing means 4 comprises a rotatable table 4*a* rotated in a direction shown by the arrow R4, and three developing devices mounted on the rotatable table 4*a*, i.e. a magenta developing device 141 (referred to as "M developing device" hereinafter) including magenta (M) toner, a cyan developing device 142 (referred to as "C developing device" hereinafter) including cyan (C) toner, and an yellow developing device 143 (referred to as "Y developing device" hereinafter) including yellow (Y) toner. The BK developing device 144 effects development at an exclusive developing station disposed at an upstream side of the photosensitive drum 1, and the M developing device 141, C developing device 142 and Y developing device 143 effect developments at a common developing station disposed at a downstream side of the photosensitive drum 1.

The BK developing device 144 is fixedly arranged between the upstream exposure device 3 and the downstream rotatable developing means 4 to separate them from each other. A rear end (an end of a portion covering the rotatable developing means and remote from the photosensitive drum 1) T of the BK developing device 144 is spaced apart from a rotation axis 0 of the rotatable developing means 4 by a predetermined distance or more outwardly in a horizontal direction. The predetermined distance is ½ of a maximum rotation radius r of the rotatable developing means 4 or more. That is to say, the rear end T of the BK developing device 144 is disposed outwardly (apart from the drum 1) from the rotation axis 0 of the rotatable developing device 4 in the horizontal direction by a distance of r/2 or more. With this arrangement, the BK developing device 144 substantially covers an upper portion of the rotatable developing means 4, and a rotating air flow for conveying scattered toner is generated between the upper BK developing device 144 and the lower rotatable developing means 4, which will be described later.

When the rotatable developing means 4 is rotated in a direction shown by the arrow R4, a desired developing device to be used for development (in FIG. 1, M developing device 141) is opposed to the photosensitive drum 1 at the developing station. The rotational direction (anti-clockwise direction shown by the arrow R4) of the rotatable developing means 4 is the same as the rotational direction (shown by the arrow R1) of the photosensitive drum 1 and is opposite to the rotational direction (shown by the arrow R5) of the intermediate transfer drum 5. In this way, since the rotational direction R4 of the rotatable developing means 4 is opposite to the rotational direction R5 of the intermediate transfer drum 5, the surfaces of these elements 4, 5 facing each other are moved in the same direction.

Incidentally, in case where the rotational direction of the rotatable developing means 4 is set to the direction R4, as is in the example of FIG. 15, when the four color developments are successively effected as M→C→Y→BK, as shown in FIG. 1, the M developing device 141, C developing device 142 and Y developing device 143 of the rotatable developing means 4 are arranged along the rotational direction (shown by the arrow R4) in order.

In the present invention, the reason why the BK developing device 144 is arranged above the rotatable developing means 4 as mentioned above is that, in consideration of normal printers, since the black toner is consumed more than the other toners, when it is desired to contain a large amount of black toner in the BK developing device, if the BK developing device is incorporated into the rotatable developing means, the entire developing means becomes bulky and that the scattering of toner can be reduced by providing the BK developing device independently from the rotatable developing means. The prevention of the toner scattering is essential to prevent the interior of the apparatus from being smudged with toner, and, in particular, to prevent the exposure device 3 and the reflection mirror 31 from being smudged with toner.

Next, the operation of the image forming apparatus and the advantage of the present invention will be fully explained with reference to FIG. 1. Incidentally, FIG. 1 shows a condition that the M developing device 141 of the rotatable developing means 4 is positioned at the developing station in a stand-by condition.

(1) A latent image corresponding to a first color or magenta (M) image is formed on the photosensitive drum 1, and then the development is effected in the condition shown in FIG. 1. The magenta toner image visualized by the magenta toner on the photosensitive drum 1 is transferred onto the outer surface of the intermediate transfer drum 5 while the photosensitive drum 1 is being rotated in the direction R1 in FIG. 1 (anti-clockwise direction). In the transferring operation, the voltage having polarity opposite to charging polarity of the toner is applied to the hollow cylinder 51 of the intermediate transfer drum 5 by the power source 61. After the first color magenta toner image was transferred to the intermediate transfer drum 5, the surface of the photosensitive drum 1 is cleaned by the cleaning device 14.

(2) Then, a latent image corresponding to a second color or cyan (C) image is formed on the photosensitive drum. In order to develop this latent image, the rotatable developing means 4 is rotated in the direction R4 (anti-clockwise direction as same as the photosensitive drum 1). In this case, a rotating air flow $W_1$ is generated by the rotation of the developing means, and a rotating air flow ($W_1$+$W_2$) directing toward the photosensitive drum 1 is generated between the rotatable developing means 4 and the intermediate transfer drum 5 by the combination of the air flow $W_1$ and a rotating air flow $W_2$ generated by the rotation of the intermediate transfer drum 5.

Thus, the scattering of toner tending to be dropped onto the convey guide 13 can be reduced. Further, due to the rotation of the rotatable developing means, a weak rotating air flow $W_0$ advancing along the rotational direction (shown by the arrow R4) of the rotatable developing means 4 is also generated in a space S between the rotatable developing means 4 and the BK developing device 144. However, as shown in FIG. 1, since the rotating air flow $W_0$ is air flowing from the narrow space S to a wide atmosphere, an amount of the air is small. In any way, the scattered toner directing toward the convey guide 13 and the exposure device 3 can be reduced by appropriately designing and arranging the BK developing device 144 and the rotatable developing means 4 and by selecting the rotational directions of the rotatable developing means 4 and the intermediate transfer drum 5.

Prior to development of the cyan image, the rotatable developing device 4 is rotated in the direction R4 by 120 degrees until the M developing device 141 is shifted to a position where the Y developing device 143 was positioned in FIG. 1. During this rotation, although the M toner is scattered from the M developing device 141, since the BK developing device 144 is designed and arranged so that the rear end T of the BK developing device 144 is spaced apart from the rotation axis 0 of the rotatable developing means 4 outwardly (away from the drum 1) in the horizontal direction by the distance more than ½ of the maximum rotation radium r, and since the rotatable developing means 4 is rotated in the anti-clockwise direction, the magenta toner is hard to be scattered but is merely adhered to the lower surface of the BK developing device 144, thereby preventing the toner from scattering within the apparatus.

(3) Similarly, the development with cyan toner, the transferring of the cyan toner image onto the intermediate transfer drum 5, and the cleaning of the surface of the photosensitive drum 1 by the cleaning device 14 are effected.

(4) Similar to the above (2) and (3), the development with yellow toner, the transferring of the yellow toner image onto the intermediate transfer drum 5, and the cleaning of the surface of the photosensitive drum 1 by the cleaning device 14 are effected.

(5) Then, the development with black toner, the transferring of the black toner image onto the intermediate transfer drum 5, and the cleaning of the surface of the photosensitive drum 1 by means of the cleaning device 14 are effected.

By successively performing the above image forming and transferring processes (1)–(5), the four toner images (magenta, cyan, yellow and black toner images) are successively transferred onto the outer surface of the intermediate transfer drum 5 in a superimposed fashion, thereby forming a composite color toner image (mirror image which is obtained by mirror-imaging an image to be finally transferred onto a transfer material) corresponding to a desired color image. On the other hand, a transfer material (paper sheet) P is separated and supplied one by one from the sheet supply cassette 9 by the sheet supply roller 10, and the separated transfer sheet is sent to the transfer station defined by the transfer device (corona charger) 7 and the turn roller 7*a* through the pair of regist rollers h1 and the transfer guide 12 at a predetermined timing. Now, 0 Volt or bias having a polarity (minus in the illustrated embodiment) opposite to that of the pre-process and the same as the charging polarity of the toner is applied to the hollow cylinder 51 by the second bias power source 62. Further, when the toner image is transferred onto the transfer sheet P supplied at the predetermined timing, transfer bias having polarity (plus) opposite to toner charging polarity (minus in the illustrated embodiment) is applied to the transfer device 7 by the third bias power source 71.

Then, as is in the example shown in FIG. 15, the four color toner images on t he intermediate transfer drum 5 are transferred onto the transfer sheet collectively, and the toner images are fused and mixed by the fixing device 15, thereby forming a permanent color image on the transfer sheet. Then, the transfer sheet is discharged out of the image forming apparatus as a color copy.

On the other hand, after the transferring operation, the intermediate transfer drum 5 is cleaned by the belt cleaning device 8. The belt cleaning device 8 is a cleaning device for the intermediate transfer drum 5 and is normally inoperative to the intermediate transfer drum 5. However, after the toner images were transferred to the transfer sheet P, the belt cleaning device 8 is abutted against the outer surface of the intermediate transfer drum 5, thereby cleaning the outer surface of the intermediate transfer drum 5.

By the way, it is desirable that the intermediate transfer drum 5 is being rotated while the color copy is being outputted from the image forming apparatus in order to enhance the through-put of the print. Further, although the continuous rotation of the intermediate transfer drum 5 is also desirable to prevent the toner from scattering within the apparatus, in consideration of the above-mentioned mechanism, the intermediate transfer drum 5 may be rotated at least during the rotation of the rotatable developing means 4.

Further, so long as the illustrated arrangement can be achieved, the photosensitive drum may be made compact as much as possible, and, in effect, a diameter of the photosensitive drum is preferably 30–100 mm. Further, a diameter of the intermediate transfer drum 5 is desirable to be made greater to increase the rotating air flow $W_2$ so that the amount of the air flow $(W_1+W_2)$ directing toward the photosensitive drum 1, thereby improving the toner scatter prevention ability.

Thus, it is preferable that the diameter of the intermediate transfer drum is greater than 160 mm.

Incidentally, in the illustrated embodiment, while an example that the hollow cylindrical intermediate transfer drum 5 is used as the intermediate transfer member was explained, the present invention is not limited to such as example, but, a solid roller may be used as the intermediate transfer drum.

Now, concrete dimensions of various elements in the illustrated embodiment will be described.

| | |
|---|---|
| Diameter of photosensitive drum 1 | 60 mm |
| Rotation radium of rotatable developing means 4 | 90 mm |
| Distance between rear end T of BK developing device 144 and rotation axis 0 | 45 mm |
| Diameter of intermediate transfer drum 5 | 180 mm |
| Peripheral speed (process speed) of photosensitive drum 1 | 100 mm/sec. |

Incidentally, in the illustrated embodiment, each of magenta toner, cyan toner and yellow toner contained in the rotatable developing means 4 is non-magnetic two-component (toner and carrier) developer.

By using the above-mentioned image forming apparatus, when full-color images were formed on 5000 transfer sheets, it was found that:

(1) although a small amount of magenta, cyan and yellow toners were adhered to the lower surface of the BK developing device 144, substantially no toner was scattered outwardly from a border positioned inwardly from the rear end T of the BK developing device 144 by 20 mm;

(2) an amount of toner scattered onto the convey guide 13 was small, and, thus, the apparatus was clearly improved in comparison with the example of FIG. 15; and (3) the toner contamination regarding the exposure device 3, reflection mirror 31 and charge device 2 was greatly improved in comparison with the example of FIG. 15, and, particularly, there was no problem regarding the poor exposure and poor image density due to the toner contamination of the reflection mirror 31.

Second Embodiment

Figure 2:
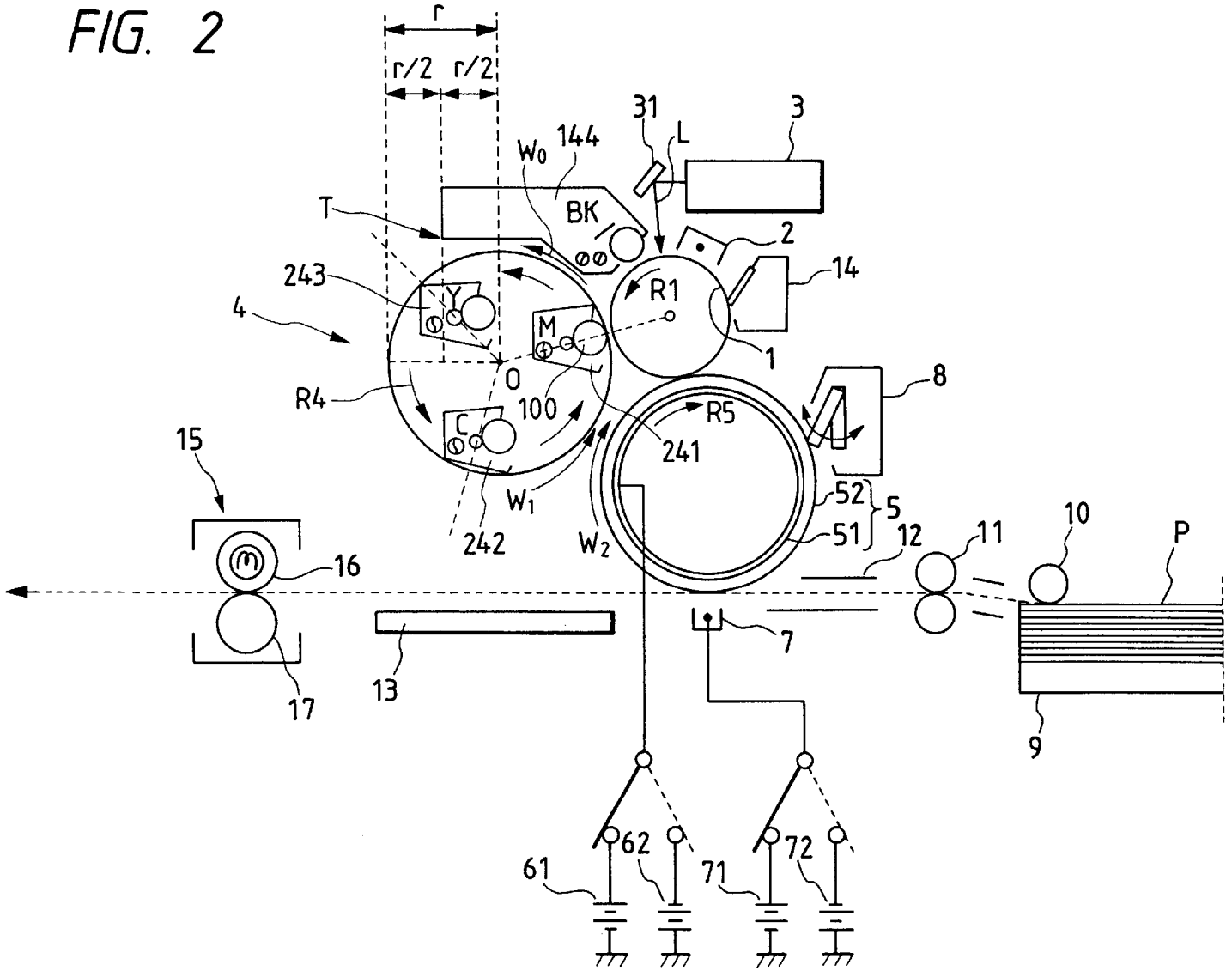
FIG. 2 is a schematic elevational sectional view of a multi-color image forming apparatus according to a second embodiment of the present invention.

While the image forming apparatus of the first embodiment had the developing means containing two-component developer including non-magnetic toner, in a second embodiment, a developing means contains therein non-magnetic one-component developer and is designed as shown in FIG. 2. The other construction in FIG. 2 is the same as the first embodiment.

Figure 3:
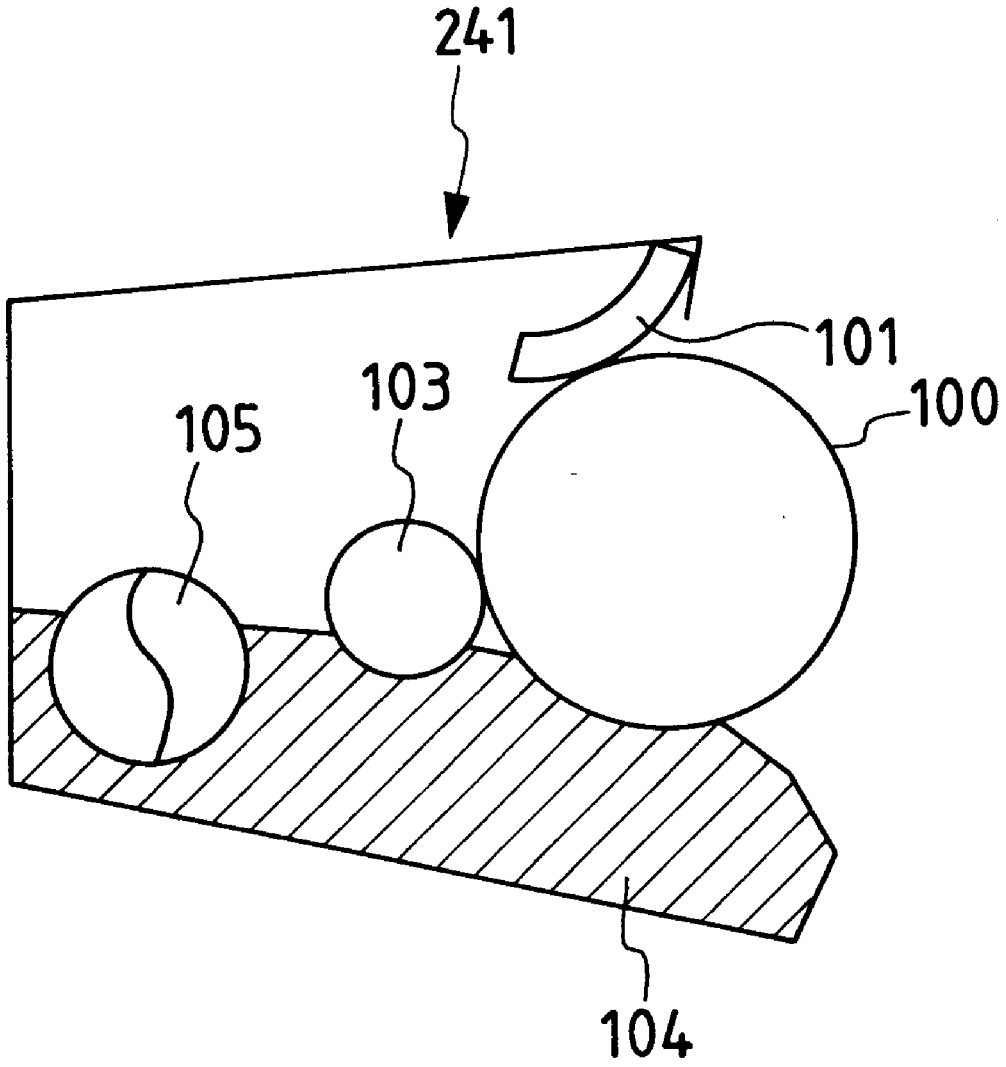
FIG. 3 is an enlarged sectional view of a developing device of a rotatable developing means according to a second embodiment.

In a rotatable developing means 4 according to the second embodiment, for example, a magenta (M) developing device 241 includes at least a developing roller (developer bearing member) 100, a regulation blade (developer regulating member) 101, and non-magnetic toner (M toner) 104, as shown in FIG. 3. In the illustrated embodiment, the developing device 241 further includes a supply roller 103 for supplying the toner and an agitating member 105.

In general, in a developing device containing non-magnetic one-component developer, since the developer does not include carrier or magnetic powder, the developer is apt to be scattered from the developing device. Regarding the toner which is apt to be scattered as is in the second embodiment, the same technical advantage as that of the first embodiment can be obtained in the following manner.

In the second embodiment, a small gap of about 300 $\mu$m is maintained between the developing roller 100 and the photosensitive drum 1, and overlap voltage obtained by overlapping AC voltage with DC voltage (i.e. DC voltage $V_{PP}$ of 1600 V having AC frequency of 1800 Hz and DC voltage $V_{DC}$ of −500 V) is applied to the developing roller 100 as developing bias (not shown). Incidentally, the toner has minus polarity. A C developing device 242 and a Y developing device 243 have the same construction as that of the M developing device.

When the color images were copied on 5000 transfer sheets in the same condition as that of the first embodiment, substantially the same advantage as that of the first embodiment could be obtained.

Incidentally, regarding the developing bias applied to the developing roller 100, even when only the DC voltages are applied to the roller, it is considered that the same advantage (obtained by applying the overlap voltage is applied) can be achieved. Further, it should be noted that a dimension of the small gap between the developing roller 100 and the photosensitive drum 1 is not limited to 300 $\mu$m.

Third Embodiment

Figure 4:
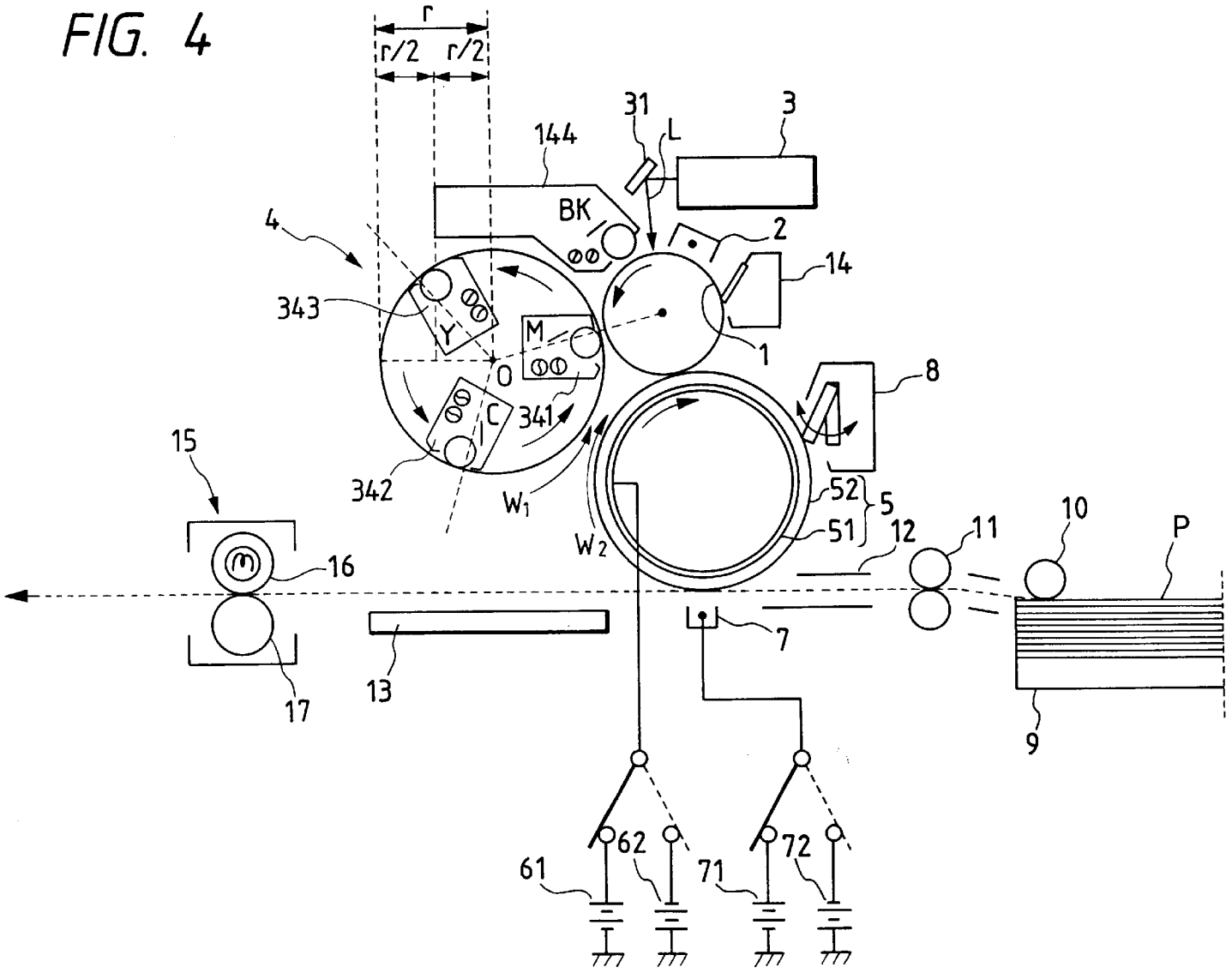
FIG. 4 is a schematic elevational sectional view of a multi-color image forming apparatus according to a third embodiment of the present invention.

As shown in FIG. 4, in a rotatable developing means 4 according to a third embodiment, color developing devices (M developing device 341, C developing device 342 and Y developing device 343) are equidistantly arranged in a circumferential direction around the rotation axis 0. In such a developing means 4, the toner is particularly apt to be scattered within the image forming apparatus and onto the convey guide 13.

According to the third embodiment, even when such a developing means 4 is used, the same technical advantage as that of the first embodiment can be obtained. The third embodiment is the same as the first embodiment except for the construction of the rotatable developing means 4.

With this arrangement, when full-color images were copied on 3000 transfer sheets, it was found that:

(1) only a small amount of magenta, cyan and yellow toners were adhered to the lower surface of the BK developing device 144;

(2) although the toner was scattered onto the convey guide 13, an amount of scattered toner was greatly reduced in comparison with the example of FIG. 15; and (3) the toner contamination of the exposure apparatus 3, reflection mirror 31 and charge device 2 was greatly reduced in comparison with the example of FIG. 15, and, particularly, there was no poor image due to the toner contamination of the reflection mirror 31.

Fourth Embodiment

In a fourth embodiment, toner used in the rotatable developing means 4 is formed from substantially spherical toner (referred to as "polymerized toner" hereinafter) including low softing point material manufactured by polymerization method of 5–30 weight % and having shape coefficient SF1 of 100–110.

The low softing point material used in this embodiment is compound having maximum peak value of 40–90° C. measured on the basis of ASTM D3418-8. The temperature of the maximum peak value of the polymerized toner used in this embodiment is measured by using DSC-7 sold by Perkin Elemer Inc. for example. The correction of temperature of a detection portion is effected by using melting points of indium and zinc, and the correction of calory is effected by using heat of fusion of indium. An aluminium pan was used as a sample, and a vacant pan was prepared as a comparable pan. The measurement was performed at a temperature increasing speed of 10° C./min. More specifically, parafin wax, polyorefin wax, Fisher Tropsch Waxes, amide wax, higher fatty acid, esterwax, and derivatives thereof or graft/block compound thereof can be utilized. Preferably, esterwax having one or more long-chain ester portion having numbers of carbon of 10 or more among the general structure equations shown in FIG. 17 is used. The structure equations of the typical and concrete esterwax compound used in this embodiment are shown in FIG. 17 as general structure equations (1), (2) and (3).

The esterwax preferably used in this embodiment has hardness of 0.5–5.0. The hardness of the esterwax is measured as Vickers hardness by using a dynamic supermicro hardness measuring device (DUH-200) sold by Shimazu Seisakusho Co. in Japan regarding a cylindrical sample having a diameter of 20 mm and a thickness of 5 mm. In the measuring method, after the sample is shifted by 10 $\mu$m under a load of 0.5 gram at a loading speed of 9.67 mm/sec, the sample is left for 15 seconds, and then the dimension of the depression is measured to determined the Vickers hardness. The hardness of the esterwax preferably used in this embodiment is 0.5–5.0. The concrete structures of the esterwax are shown in FIGS. 18A, 18B, 19A and 19B.

Now, the fourth embodiment will be explained with reference to FIG. 1. Incidentally, the similar polymerized toner is used in the BK developing device 144. Since the polymerized toner is spherical, it has good fluidity, and, thus, is apt to be scattered. Accordingly, in particular, in a rotatable developing means 4 in which the toner is apt to be scattered, the toner contamination of a convey path including the convey guide 13, exposure device 3 and reflection mirror 31 due to the scattering of toner must be effectively avoided.

Also in this embodiment, when the same test as the first embodiment was performed, it was found that the scattering of toner regarding the rotatable developing means 4 could be considerably reduced in comparison with the conventional rotatable developing means. Particularly, the advantage was remarkable with respect to the convey path including the convey guide 13 and was also effective to the exposure device 3 and the reflection mirror 31.

Figure 16:
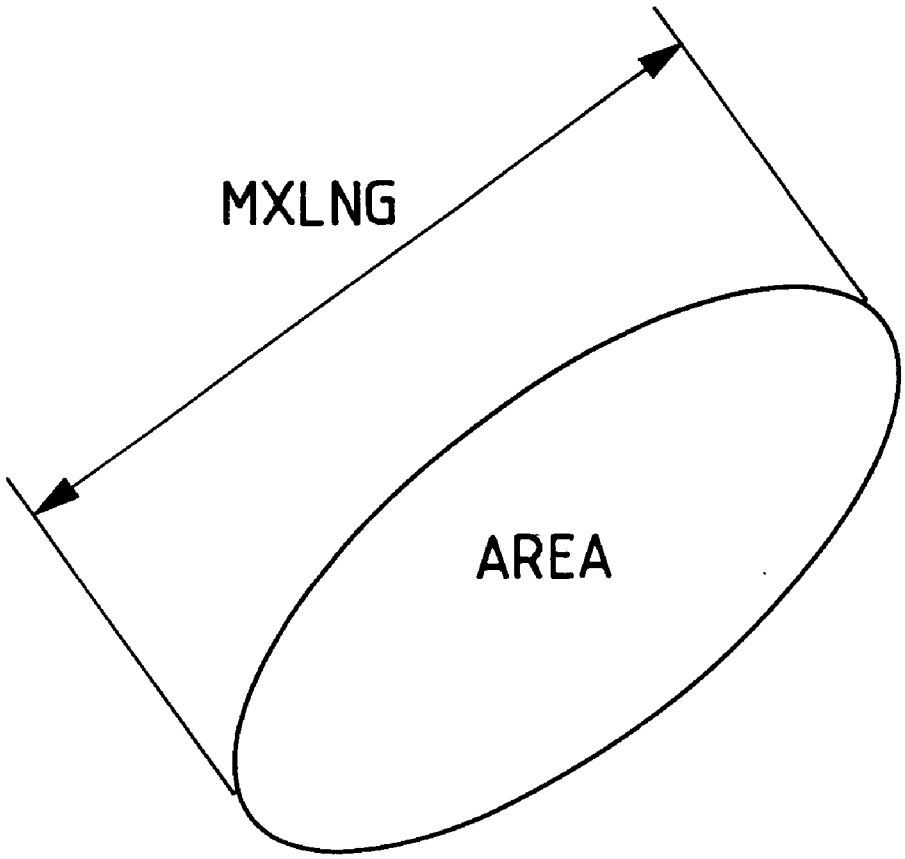
FIG. 16 is a view for explaining a shape coefficient SF1.
Figure 18A:
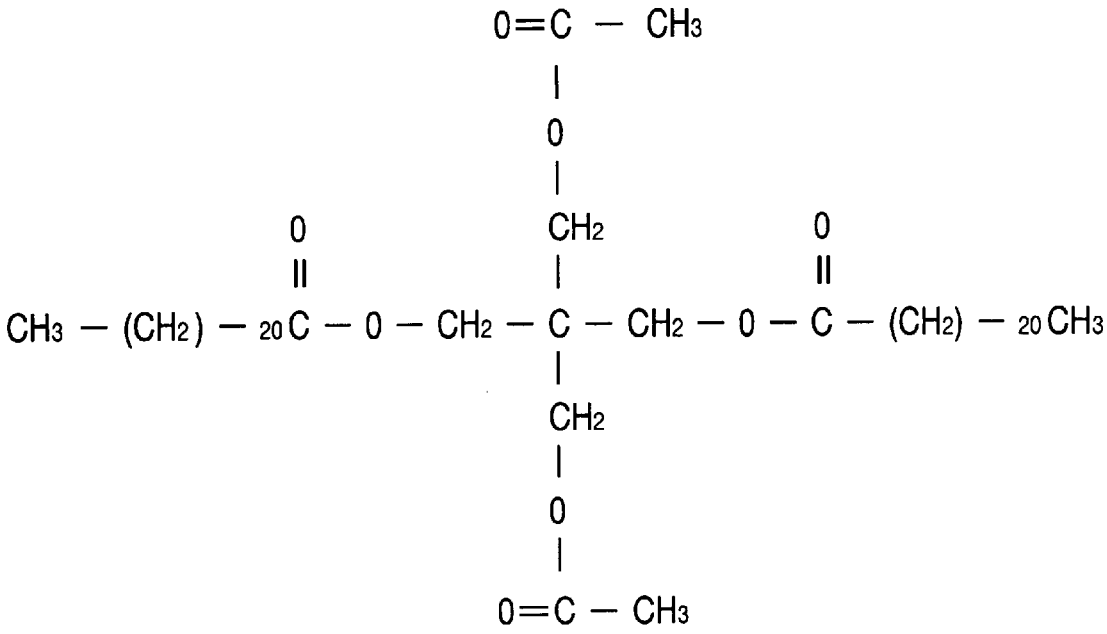
FIGS. 18A and 18B and FIGS. 19A and 19B are views showing concrete structures of the esterwax.
Figure 18B:
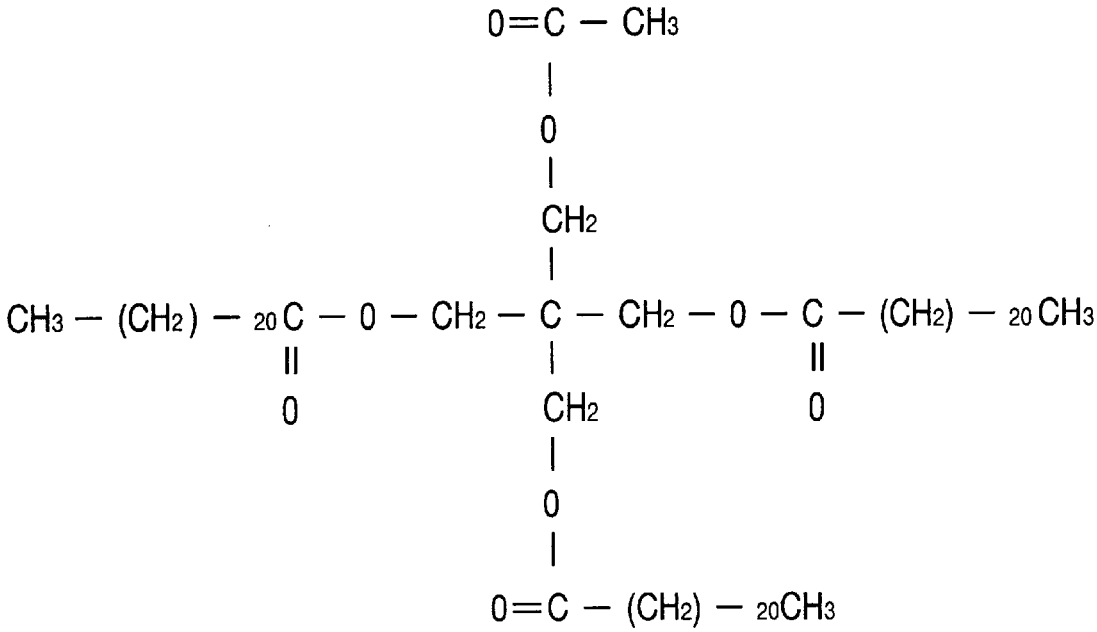
Figure 19A:
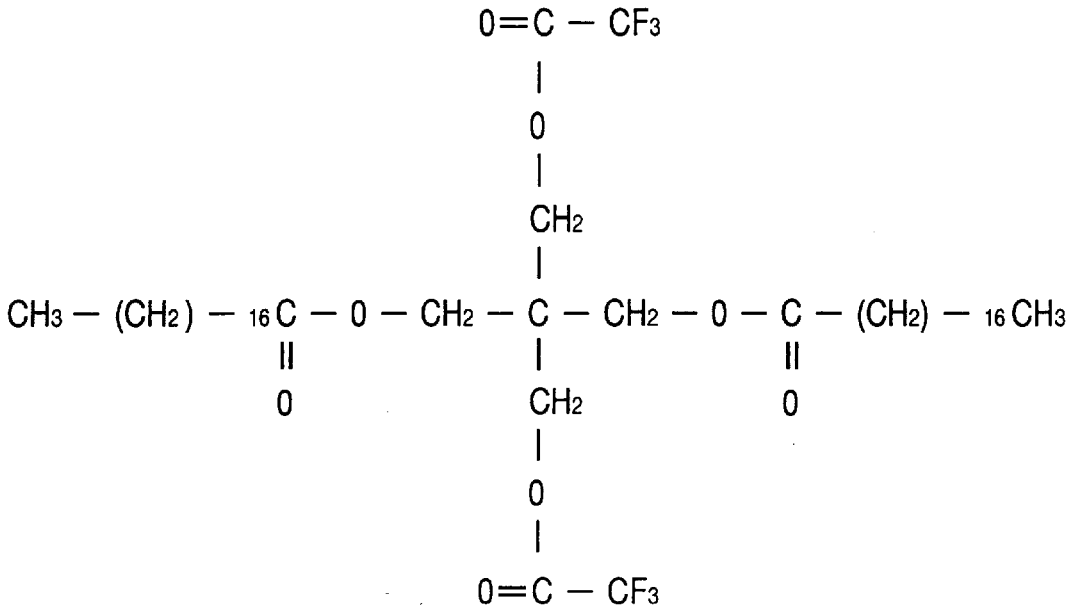
Figure 19B:
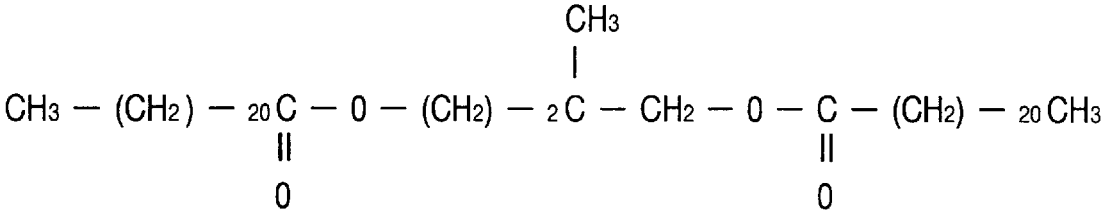

Incidentally, as shown in FIG. 16, the shape coefficient is the rate of roundness regarding the shape of the spherical material, and a value thereof is obtained by dividing the square a maximum length (MXLNG) of an ellipse formed by projecting a spherical material onto a two-dimensional plane by an area (AREA) of the ellipse and then by multiplying the result by (100π/4). That is to say, the shape coefficient SF1 can be represented by the following equation:

$$SF1=\{(MXLNG)^2/AREA\}\times(100\pi/4).$$

In the illustrated embodiment, FE-SEN (S-800) sold by Hitachi Seisakusho Co. in Japan was used, and the toner images were sampling at random by 100 times. The obtained image information was introduced into an image analyzing apparatus (Lusex 3) sold by NIRECO Co. to be analyzed, the shape coefficient was calculated by using the above equation on the basis of the result.

Fifth Embodiment

Figure 5:
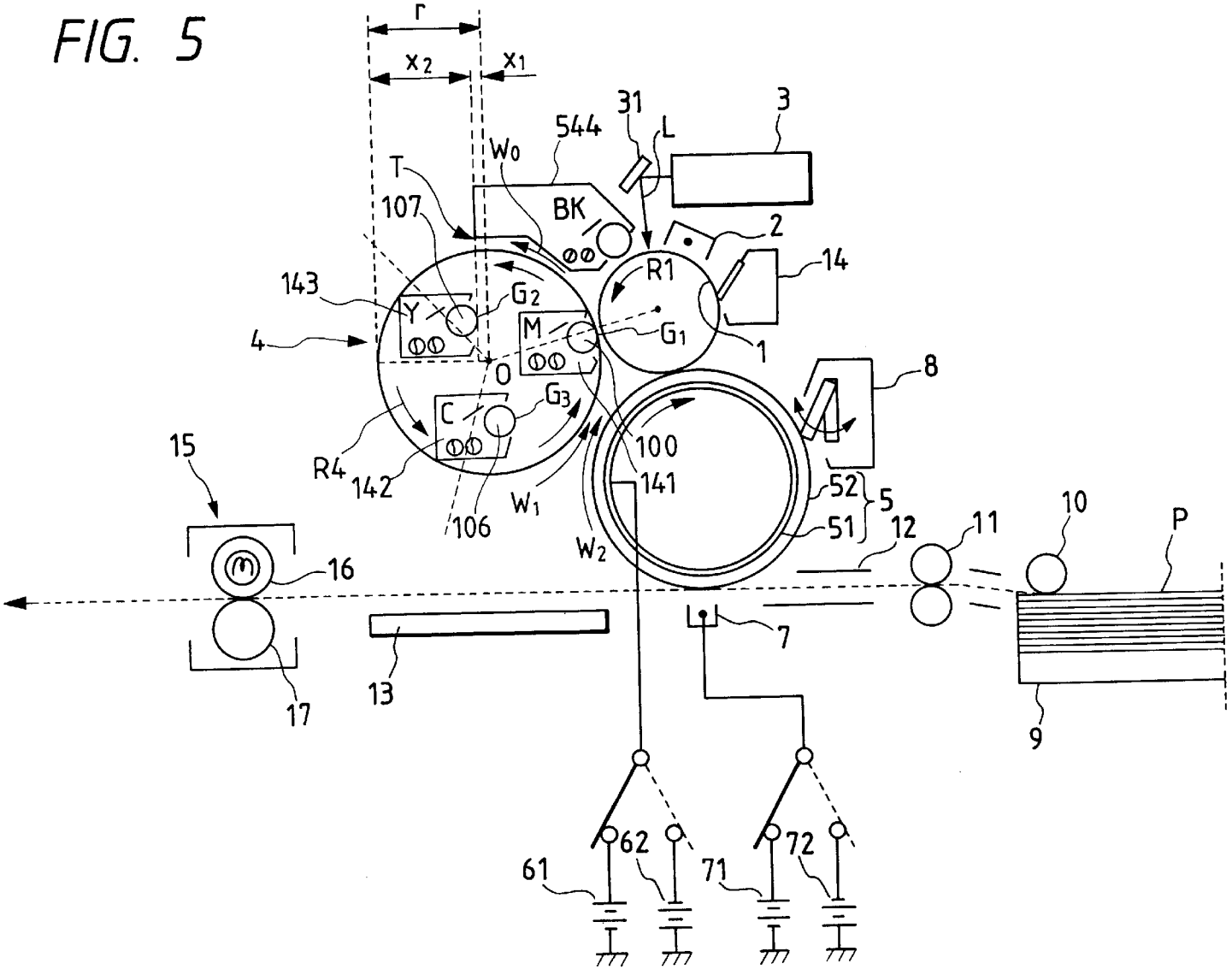
FIG. 5 is a schematic elevational sectional view of a multi-color image forming apparatus according to a fifth embodiment of the present invention.

FIG. 5 is a schematic elevational sectional view of a multi-color image forming apparatus according to a fifth embodiment of the present invention.

In FIG. 5, the intermediate transfer member is formed as an intermediate transfer drum 5 constituted by a hollow metallic cylinder 51, and an intermediate transfer layer coated on an outer surface of the cylinder. Further, the charge device 2, exposure device 3 and reflection mirror 31 (for explaining the advantage of this embodiment) are arranged around the photosensitive drum 1, and a BK developing device 544 is arranged above the rotatable developing means 4. In order to adhere the toner scattered from the rotatable developing means 4 to a lower surface of the BK developing device 544 and to reduce the scattering of toner by the rotating air flows generated by the rotations of the rotatable developing means 4 and the intermediate transfer drum 5, a rear end T of the BK developing device 544 is positioned outwardly (away from the photosensitive drum 1) of a position G corresponding to a developing position of the developing roller disposed above a horizontal line passing through the rotation axis 0 of the rotatable developing means 4 in a condition that the second color development can be performed (when the rotatable developing means 4 was rotated after the first color development was completed). Further, a transfer device 7 for transferring the toner images transferred to the intermediate transfer drum 5 onto the transfer sheet P is also provided.

This embodiment differs from the first embodiment in the point that the portions G1, G2 and G3 corresponding to the developing positions of the developing rollers 100, 106 and 107 of the various color developing devices (M developing device 141, C developing device 142 and Y developing device 143) of the rotatable developing means 4 are taken into consideration.

Now, the detailed construction and advantage of the fifth embodiment will be explained with reference to FIG. 5.

Incidentally, FIG. 5 shows a condition that the M developing device 141 is positioned at the developing station in a stand-by condition.

(1) A latent image corresponding to a first or magenta color image is formed on the photosensitive drum 1, and the development is effected in a condition shown in FIG. 5. The magenta toner image visualized by the magenta toner on the photosensitive drum 1 is transferred onto the outer surface of the intermediate transfer drum 5 while the photosensitive drum 1 is being rotated in the direction R1 (anti-clockwise direction). After the first color magenta toner image was transferred to the intermediate transfer drum 5, the surface of the photosensitive drum 1 is cleaned by the cleaning device 14.

(2) Then, a latent image corresponding to a second color or cyan (C) image is formed on the photosensitive drum. In order to develop this latent image, the rotatable developing means 4 is rotated in the direction R4 (anti-clockwise direction as same as the photosensitive drum 1). In this case, a rotating air flow $W_1$ is generated by the rotation of the developing means, and a rotating air flow ($W_1$+$W_2$) directing toward the photosensitive drum 1 is generated between the rotatable developing means 4 and the intermediate transfer drum 5 by the combination of the air flow $W_1$ and a rotating air flow $W_2$ generated by the rotation of the intermediate transfer drum 5.

Thus, the scattering of toner tending to be dropped onto the convey guide 13 can be reduced. Further, due to the rotation of the rotatable developing means, a weak rotating air flow $W_0$ advancing along the rotational direction of the rotatable developing means 4 is also generated. However, as shown in FIG. 5, the rotating air flow $W_0$ is air flowing from a narrow space to wide atmosphere, an amount of air is small. In any way, the scattered toner directing toward the convey guide 13 and the like can be reduced by appropriately designing and arranging the developing device and the rotatable developing means and by selecting the rotational directions of the rotatable developing means 4 and the intermediate transfer drum 5.

When the cyan development can be permitted, the first M developing device 141 was rotated from the developing station in the anti-clockwise direction by 120 degrees until the M developing device 141 was shifted to a position where the Y developing device 143 was positioned in FIG. 5.

In this case, the position G1 corresponding to the developing position of the M developing device 141 was moved to the position G2 in FIG. 5. During this movement, it is considered that the scattering of toner from the M developing device 141 is noticeable. In this embodiment, in consideration of this fact, the rear end T of the BK developing device 544 is positioned at least outwardly of the point G2 in FIG. 5. Further, in the illustrated embodiment, while the developing devices were equidistantly arranged in the circumferential direction (120 degrees), the similar advantage can be achieved even when the developing devices are arranged non-equidistantly along the circumferential direction. This is the reason why it is considered that the toner is mainly scattered from the developing rollers 100, 106 and 107 of the developing devices 141, 142 and 143. The present invention utilizes this point. Incidentally, a developing area formed between the surface of the photosensitive drum 1 and the developing roller positioned at the developing station normally has a width of several millimeters.

(3) Similarly, the development with cyan toner, the transferring of the cyan toner image onto the intermediate transfer drum 5, and the cleaning of the surface of the photosensitive drum 1 by the cleaning device 14 are effected.

(4) Similar to the above (2) and (3), the development with yellow toner, the transferring of the yellow toner image onto the intermediate transfer drum 5, and the cleaning of the surface of the photosensitive drum 1 by means of the cleaning device 14 are effected.

(5) Then, the image exposure L regarding the fourth black component image, the development with black toner in the BK developing device 544, the transferring of the black toner image onto the intermediate transfer drum 5, and the cleaning of the surface of the photosensitive drum 1 by means of the cleaning device 14 are effected.

By successively performing the above image forming and transferring processes (1)–(5), the four toner images (magenta, cyan, yellow and black toner images) are successively transferred onto the outer surface of the intermediate transfer drum 5 in a superimposed fashion, thereby forming a composite color toner image (mirror image) corresponding to a desired color image. Then, as is in the example shown in FIG. 15, the color copy is outputted.

By the way, it is desirable that the intermediate transfer drum 5 is being rotated while the color copy is being outputted from the image forming apparatus in order to enhance the through-put of the print. Further, although the continuous rotation of the intermediate transfer drum 5 is also desirable to prevent the toner from scattering within the apparatus, in consideration of the above-mentioned mechanism, the intermediate transfer drum 5 may be rotated at least during the rotation of the rotatable developing means 4.

Further, so long as the illustrated arrangement can be achieved, the photosensitive drum may be made compact as much as possible, and, in effect, a diameter of the photosensitive drum is preferably 30–100 mm. Further, a diameter of the intermediate transfer drum 5 is desirable to be made greater to increase the rotating air flow $W_2$ so that the amount of the air flow ($W_1$+$W_2$) directing toward the photosensitive drum 1, thereby improving the toner scatter prevention ability. Thus, it is preferable that the diameter of the intermediate transfer drum is greater than 160 mm.

Incidentally, in the illustrated embodiment, while an example that the hollow cylindrical intermediate transfer drum 5 is used as the intermediate transfer member was explained, the present invention is not limited to such as example, but, a solid roller may be as the intermediate transfer drum.

In this embodiment, dimensions of various elements are as follows:

| | |
|---|---|
| Diameter of photosensitive drum 1 | 60 mm |
| Rotation radium of rotatable developing means 4 | 90 mm |
| Distance $x_1$ between rear end T of BK developing device 544 and rotation axis 0 | 25 mm |
| Diameter of intermediate transfer drum 5 | 180 mm |
| Process speed | 100 mm/sec. |

Incidentally, in the illustrated embodiment, each of magenta toner, cyan toner and yellow toner contained in the rotatable developing means 4 is non-magnetic two-component (toner and carrier) developer.

By using the above-mentioned image forming apparatus, when full-color images were formed on 5000 transfer sheets, it was found that:

(1) although a small of magenta, cyan and yellow toners were adhered to the lower surface of the BK developing device 544, substantially no toner was scattered outwardly from the rear end T of the BK developing device 544;

(2) an amount of toner scattered onto the convey guide 13 was small, and, thus, the apparatus was clearly improved in comparison with the example of FIG. 15; and (3) the toner contamination regarding the exposure device 3, reflection mirror 31 and charge device 2 was greatly improved in comparison with the example of FIG. 15, and, particularly, there was no problem regarding the poor exposure and poor image density due to the toner contamination of the reflection mirror 31.

As mentioned above, in this embodiment, the scattering of toner within the apparatus can be greatly reduced.

Sixth Embodiment

Figure 6:
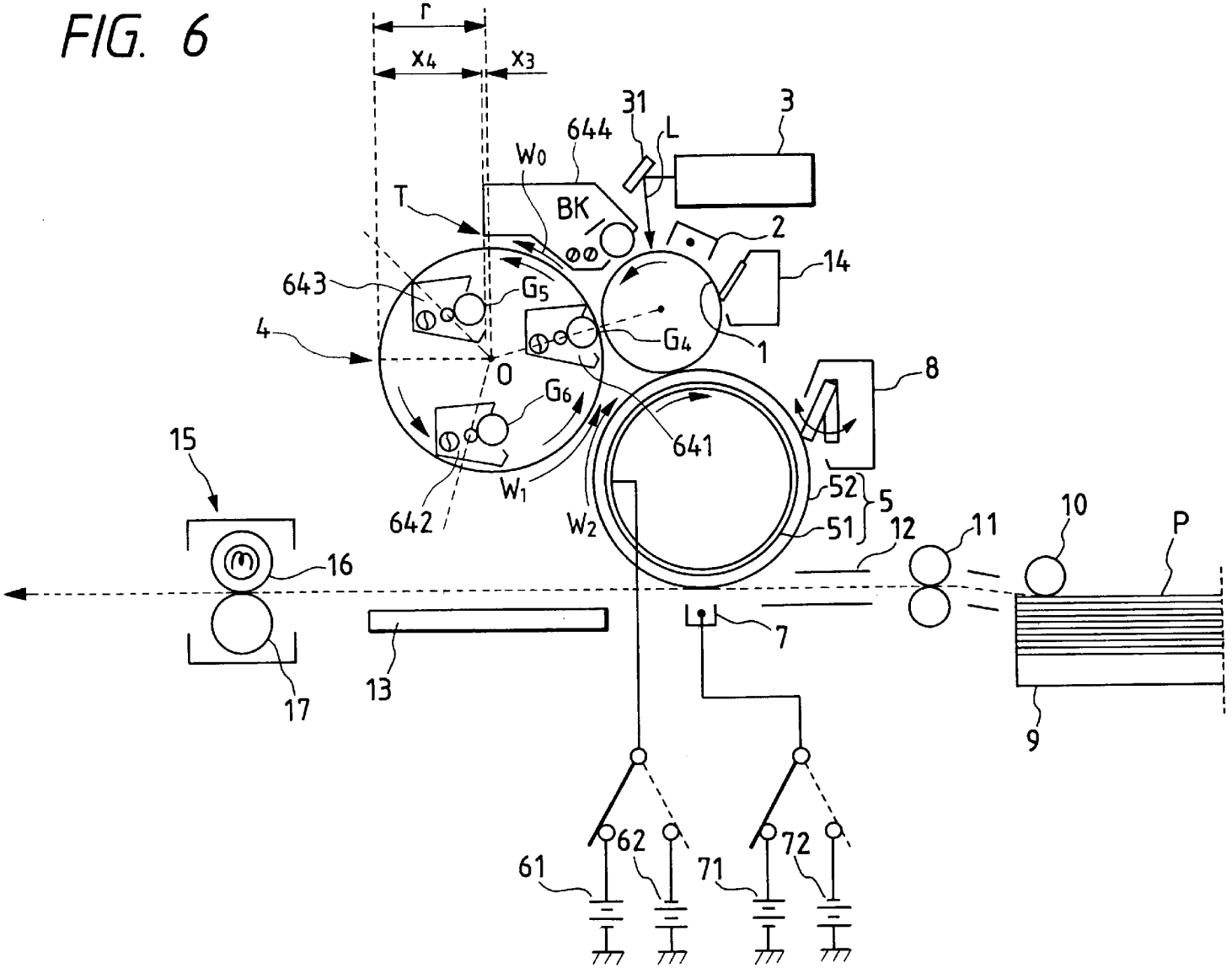
FIG. 6 is a schematic elevational sectional view of a multi-color image forming apparatus according to a sixth embodiment of the present invention.

In a multi-color image forming apparatus according to a sixth embodiment shown in FIG. 6, a developing means contains therein non-magnetic one-component developer. The construction of the developing devices other than a BK developing device is the same as those shown in FIG. 2.

In a rotatable developing means 4 according to the sixth embodiment, for example, a magenta (M) developing device 641 includes at least a developing roller 100, a regulation blade 101, and non-magnetic toner (M toner) 104, as shown in FIG. 3. In the illustrated embodiment, the developing device 641 further includes a supply roller 103 for supplying the toner and an agitating member 105. In a developing device containing non-magnetic one-component developer, since the developer does not include a carrier or magnetic powder, the developer is apt to be scattered from the developing device. That is to say, also in this embodiment, in consideration of the theory shown in the first embodiment, it is apparent that the advantage can be obtained.

In this embodiment, a small gap of about 300 $\mu$m is maintained between the developing roller 100 and the photosensitive drum 1, and DC voltage $V_{PP}$ of 1600 V having AC frequency of 1800 Hz and DC voltage $V_{DC}$ of −500 V) are applied to the developing roller 100 as developing bias (not shown). Incidentally, the toner has minus polarity. A C developing device 642 and a Y developing device 643 have the same construction as that of the M developing device 641. Incidentally, a distance between the rear end T of the BK developing device 644 and the rotation axis 0 of the rotatable developing means 4 is selected to 23 mm (this distance is equal to a distance between a point G5 in FIG. 6 and the rotation axis 0). When the color images were copied on 5000 transfer sheets in the same condition as that of the fifth embodiment, substantially the same advantage as that of the fifth embodiment could be obtained. Incidentally, regarding the developing bias applied to the developing roller 100, even when only the DC voltages are applied to the roller, it is apparent that the same advantage (obtained by applying the overlap voltage is applied) can be achieved. Further, it should be noted that a dimension of the small gap between the developing roller 100 and the photosensitive drum 1 is not limited to 300 $\mu$m.

Seventh Embodiment

Figure 7:
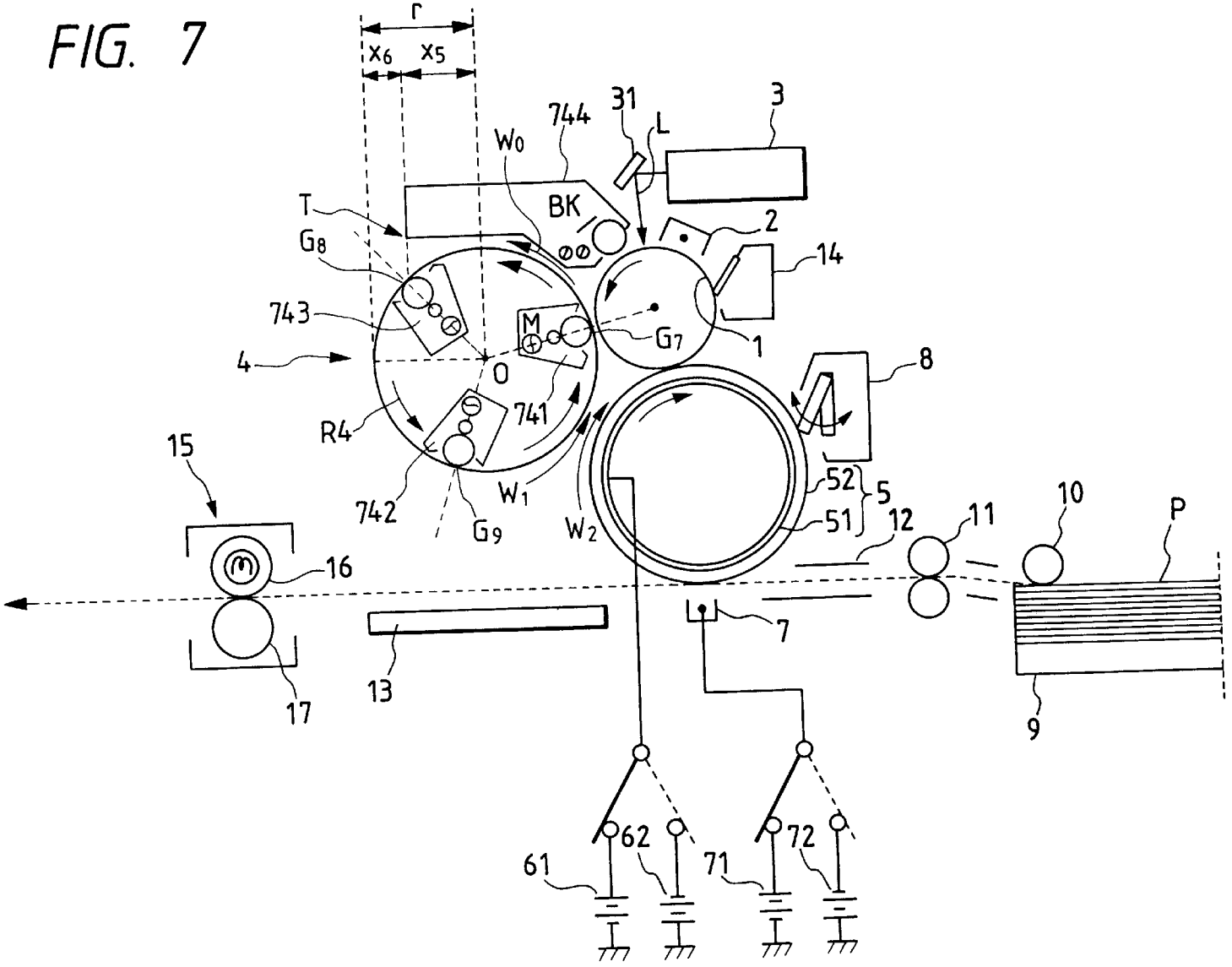
FIG. 7 is a schematic elevational sectional view of a multi-color image forming apparatus according to a seventh embodiment of the present invention.

As shown in FIG. 7, in a rotatable developing means 4 according to a seventh embodiment, color developing devices (M developing device 741, C developing device 742 and Y developing device 743) are equidistantly arranged in a circumferential direction around the rotation axis 0.

In FIG. 7, each of the color developing devices contains non-magnetic one-component developer. The bias applied to the developing roller is the same as that in the third embodiment, and the color developing devices are the same as those shown in FIG. 3.

In such a developing means 4 containing non-magnetic one-component developer according to this embodiment, the toner is particularly apt to be scattered within the image forming apparatus and onto the convey guide 13. With this arrangement, since the color developing devices (M developing device 741, C developing device 742 and Y developing device 743) are arranged as mentioned above, after the developing process was effected by using the first color M developing device 741, when the rotatable developing means 4 is rotated until the next developing device reaches the developing station, the portion G7 corresponding to the developing position of the M developing device 741 is shifted to a position G8.

In this embodiment, various dimensions are as follows:

| | |
|---|---|
| Diameter of photosensitive drum 1 | 60 mm |
| Rotation radius of rotatable developing means 4 | 90 mm |
| Distance $x_5$ between rear end T of BK developing device 744 and rotation axis 0 | 65 mm |
| Diameter of intermediate transfer drum 5 | 180 mm |
| Process speed | 100 mm/sec. |

By using the above-mentioned image forming apparatus, when full-color images were formed on 3000 transfer sheets, it was found that:

(1) although a small of magenta, cyan and yellow toners were adhered to the lower surface of the BK developing device 744, substantially no toner was scattered outwardly from the rear end T of the BK developing device 744;

(2) an amount of toner scattered onto the convey guide 13 was small, and, thus, the apparatus was clearly improved in comparison with the example of FIG. 15; and (3) the toner contamination regarding the exposure device 3, reflection mirror 31 and charge device 2 was greatly improved in comparison with the example of FIG. 15, and, particularly, there was no problem regarding the poor exposure and poor image density due to the toner contamination of the reflection mirror 31.

In this embodiment, the position of the rear end T of the BK developing device 744 may be determined on the basis of the position of the color developing devices after the respective developing process was finished.

Figure 8:
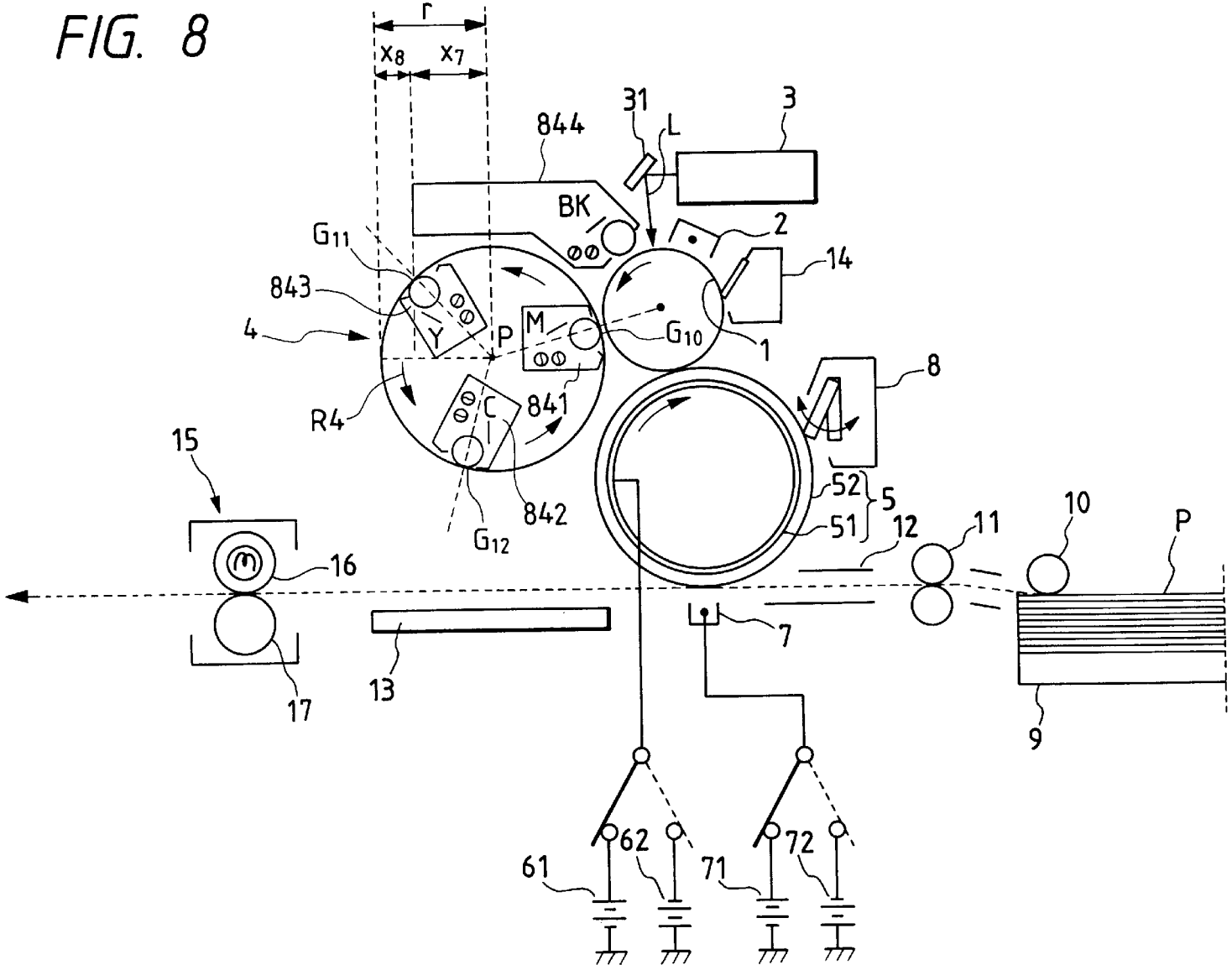
FIG. 8 is a schematic elevational sectional view showing an alteration of the multi-color image forming apparatus of the seventh embodiment.

FIG. 8 shows an alteration of the image forming apparatus of the seventh embodiment. In this alteration, each of the color developing devices contains a two-component developer. Incidentally, in FIG. 8, a distance $X_7$ is equal to the distance $X_5$, and, thus, is 65 mm. Also in this alteration, the same advantage could be obtained.

Eighth Embodiment

In this embodiment, a longitudinal dimension of the BK developing device is greater than a longitudinal dimension of the rotatable developing means.

Figure 9:
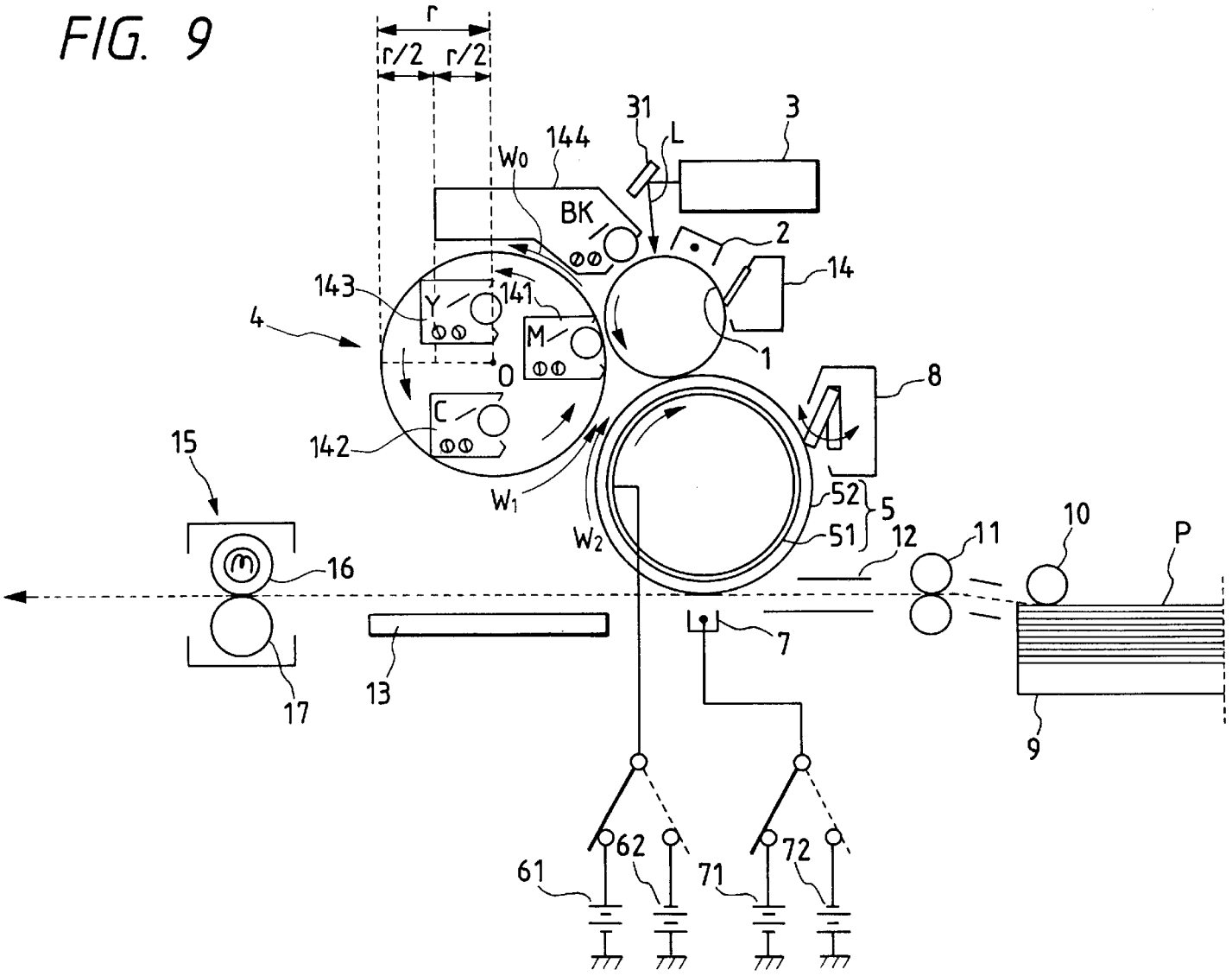
FIG. 9 is a schematic elevational sectional view of a multi-color image forming apparatus according to an eighth embodiment of the present invention.
Figure 10:
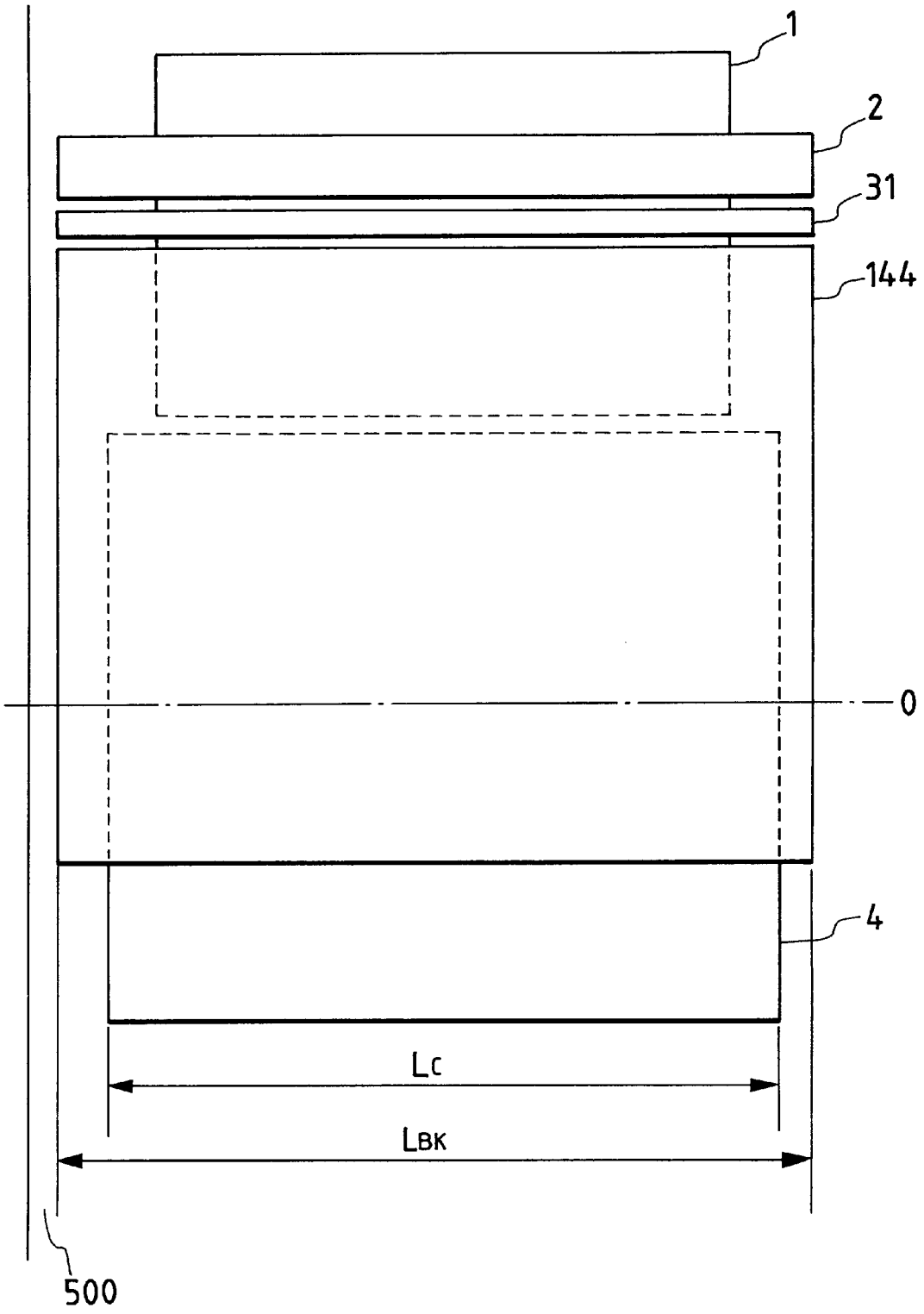
FIG. 10 is a plan view of the multi-color image forming apparatus of the eighth embodiment.

Now, the eighth embodiment will be briefly explained with reference to FIGS. 9 and 10. FIG. 9 is a schematic elevational sectional view of an image forming apparatus according to the eighth embodiment, and FIG. 10 is a plan view of the image forming apparatus. In FIG. 10, when a longitudinal dimension of the BK developing device 144 is $L_{BK}$, and a longitudinal dimension of the rotatable developing means is Lc, according to this embodiment, the following relation is satisfied:

$L_{BK}>L_C$

The other construction in this embodiment is the same as that of the first embodiment. Incidentally, the dimension Lc corresponds to a length of each color developing devices (M developing device, C developing device and Y developing device).

As is well known by any skilled person in the art, the scattering of toner from both longitudinal ends of the rotatable developing means must also be reduced in order to prevent the toner contamination of the interior of the apparatus. Since the toner scattering is caused at both longitudinal ends of the rotatable developing means 4, this embodiment is effective to reduce such toner scattering. With this arrangement, for example, the scattering of toner toward side plates 500 adjacent to the rotatable developing means 4 can be reduced.

As is in the first embodiment, when the full-color images were copied on 5000 transfer sheets, it was found that the scattering of toner toward the side plates 500 was further reduced in comparison with the first embodiment. Incidentally, in this embodiment, $(L_{BK}-L_c)$ was selected to 6 mm. However, $(L_{BK}-L_c)\geqq 6$ mm is preferable, and, if $0<(L_{BK}-L_c)<6$ mm, although the advantage is decreased, the toner scattering can be reduced more or less.

Ninth Embodiment

A ninth embodiment differs from the first to eighth embodiments in the point that an intermediate transfer belt 50 is used as the intermediate transfer member. FIGS. 11, 12, 13 and 14 show first to fourth alterations of a ninth embodiment, respectively.

The feature of the ninth embodiment is that the intermediate transfer belt 50 is used in place of the intermediate transfer drum 5, the intermediate transfer belt 50 is mounted on rollers 6, 7*a*, 7*b* and 7*c* in such a manner that a surface of the intermediate transfer belt 50 starts to be contacted with the photosensitive drum 1 from a side of the rotatable developing means (first alteration) and a rotating air flow $(W_1+W_3)$ is generated by the combination of a rotating air flow $W_3$ generated by rotation of the intermediate transfer belt 50 and a rotating air flow $W_3$ generated by rotation of the rotatable developing means 4 (first alteration). With this arrangement, the toner scattering toward the convey guide 13 can be reduced. In this embodiment, an angle θ between the intermediate transfer belt 50 and a vertical plane is selected to about 50 degrees (θ≅50°), and more preferably 45° or more. However, in consideration of the above combination, the angle may be greater than zero (0°<θ).

Figure 11:
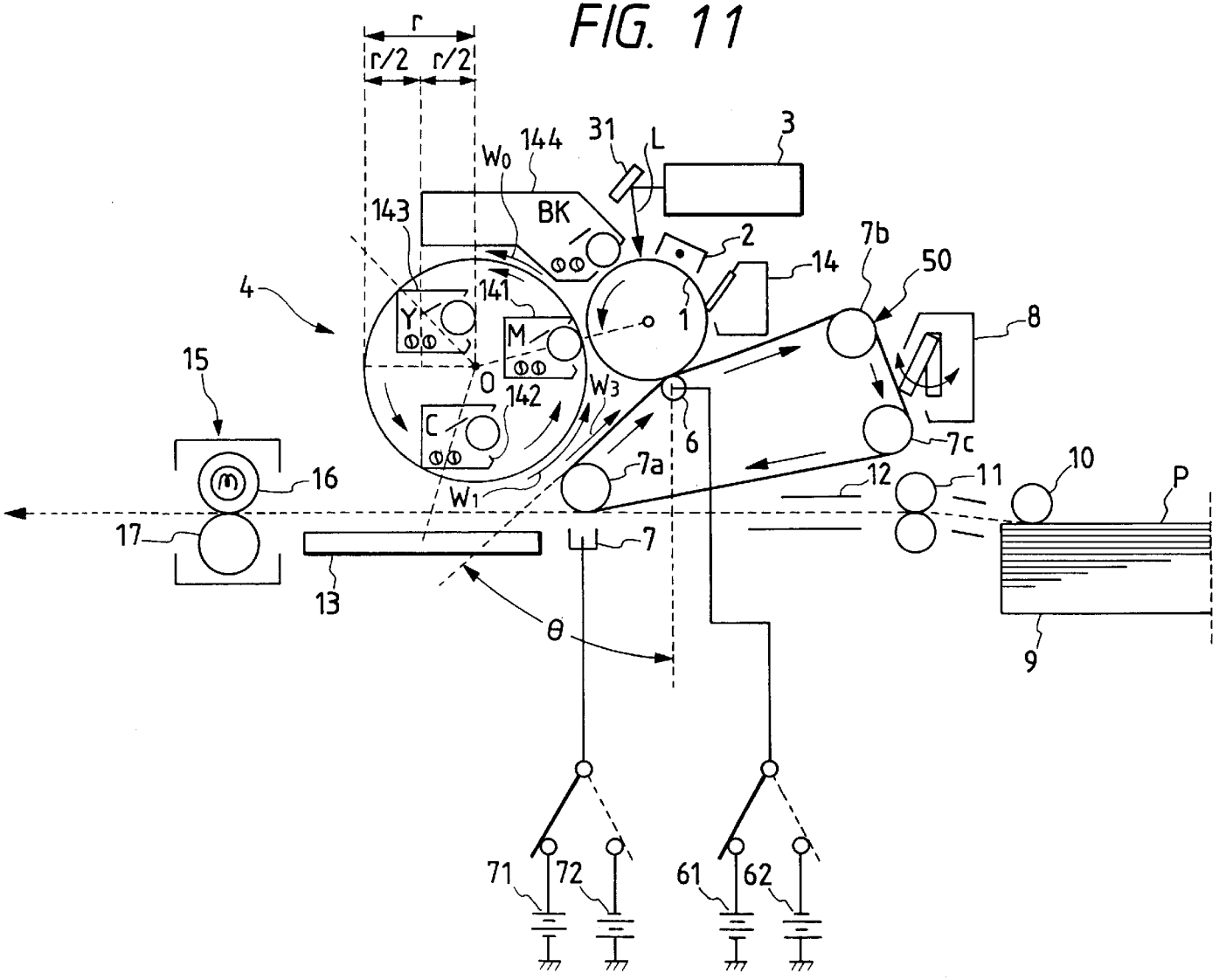
FIG. 11 is a schematic elevational sectional view showing a first alteration of a multi-color image forming apparatus of a ninth embodiment of the present invention.
Figure 12:
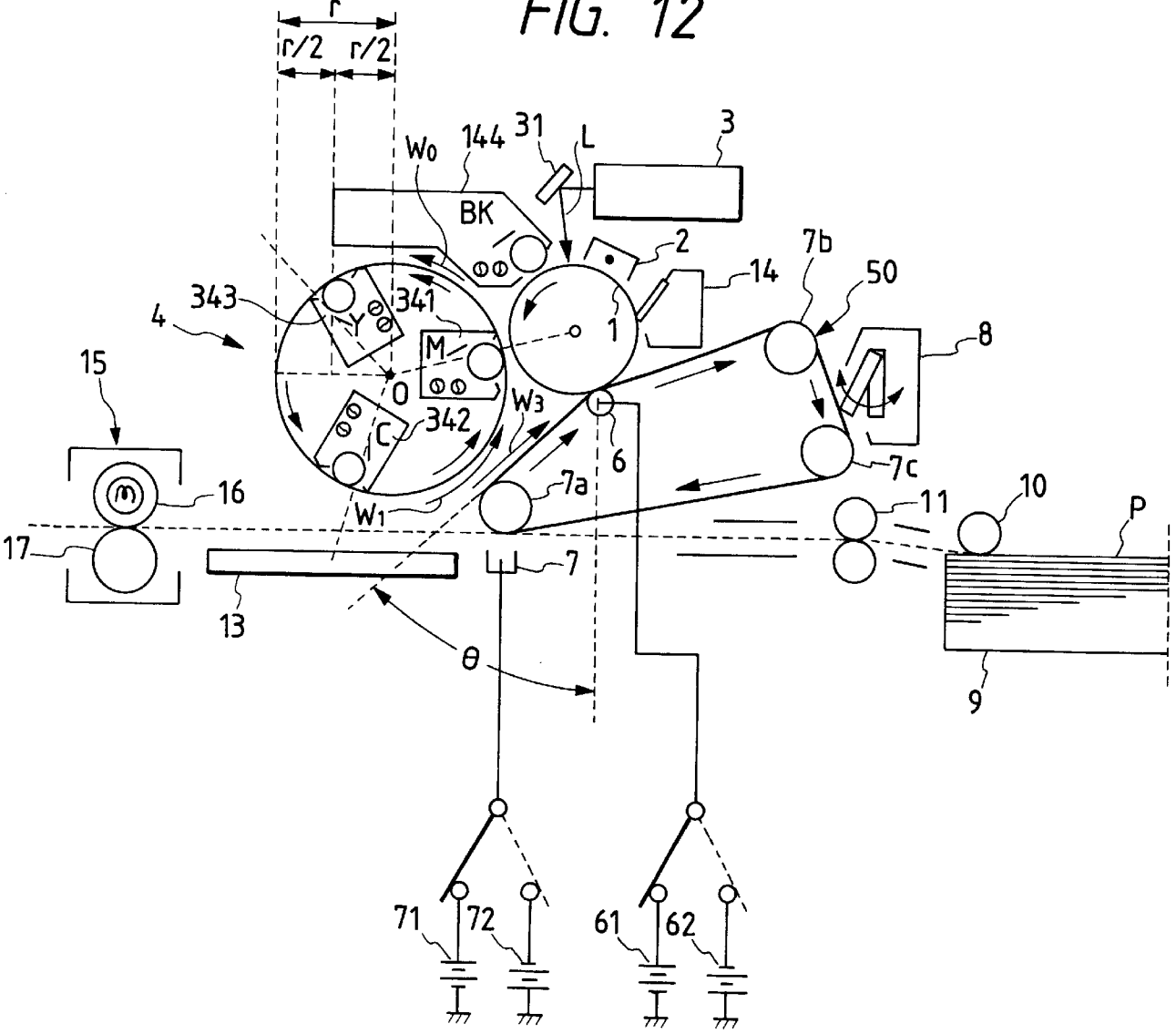
FIG. 12 is a schematic elevational sectional view showing a second alteration of the multi-color image forming apparatus of the ninth embodiment.
Figure 13:
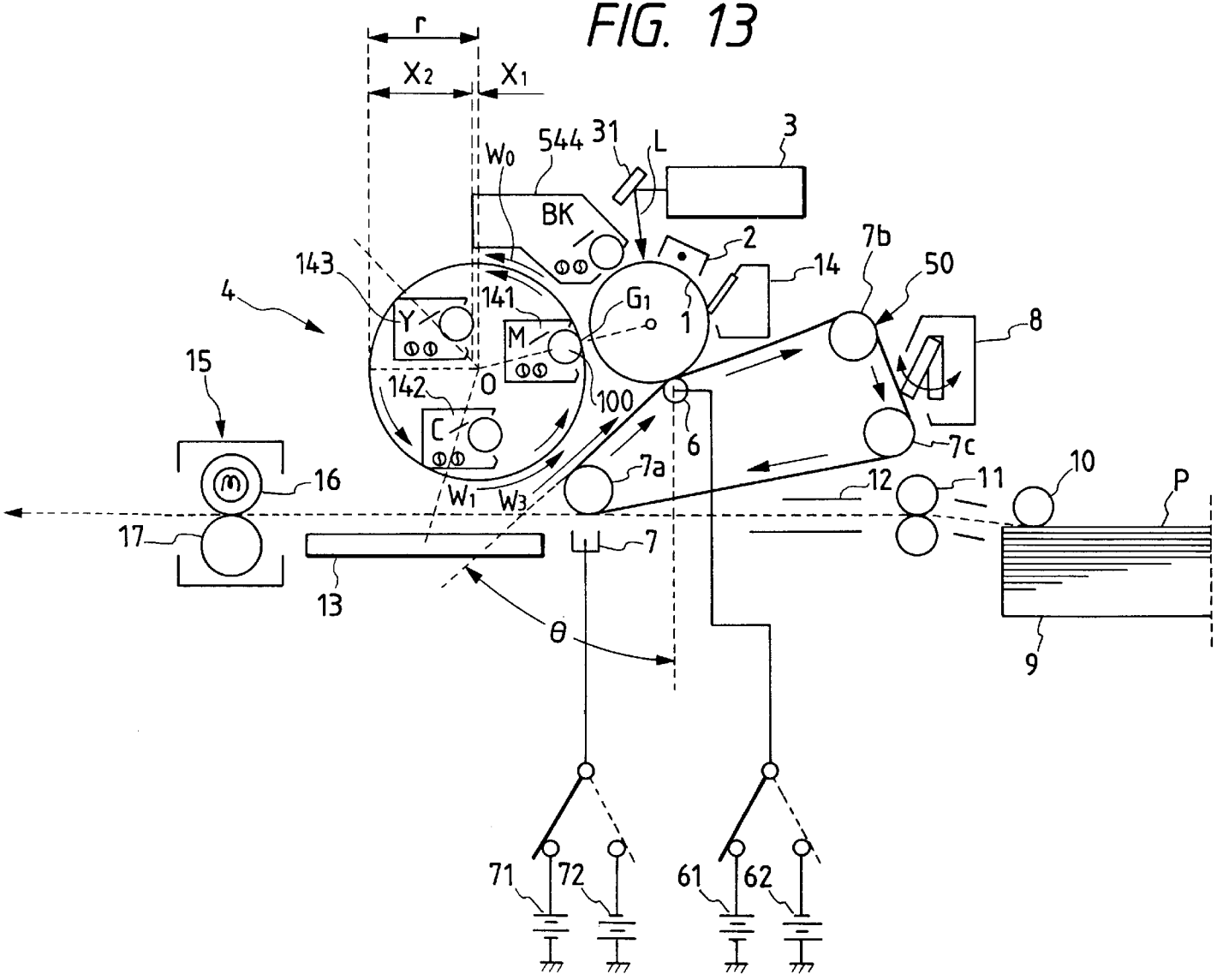
FIG. 13 is a schematic elevational sectional view showing a third alteration of the multi-color image forming apparatus of the ninth embodiment.
Figure 14:
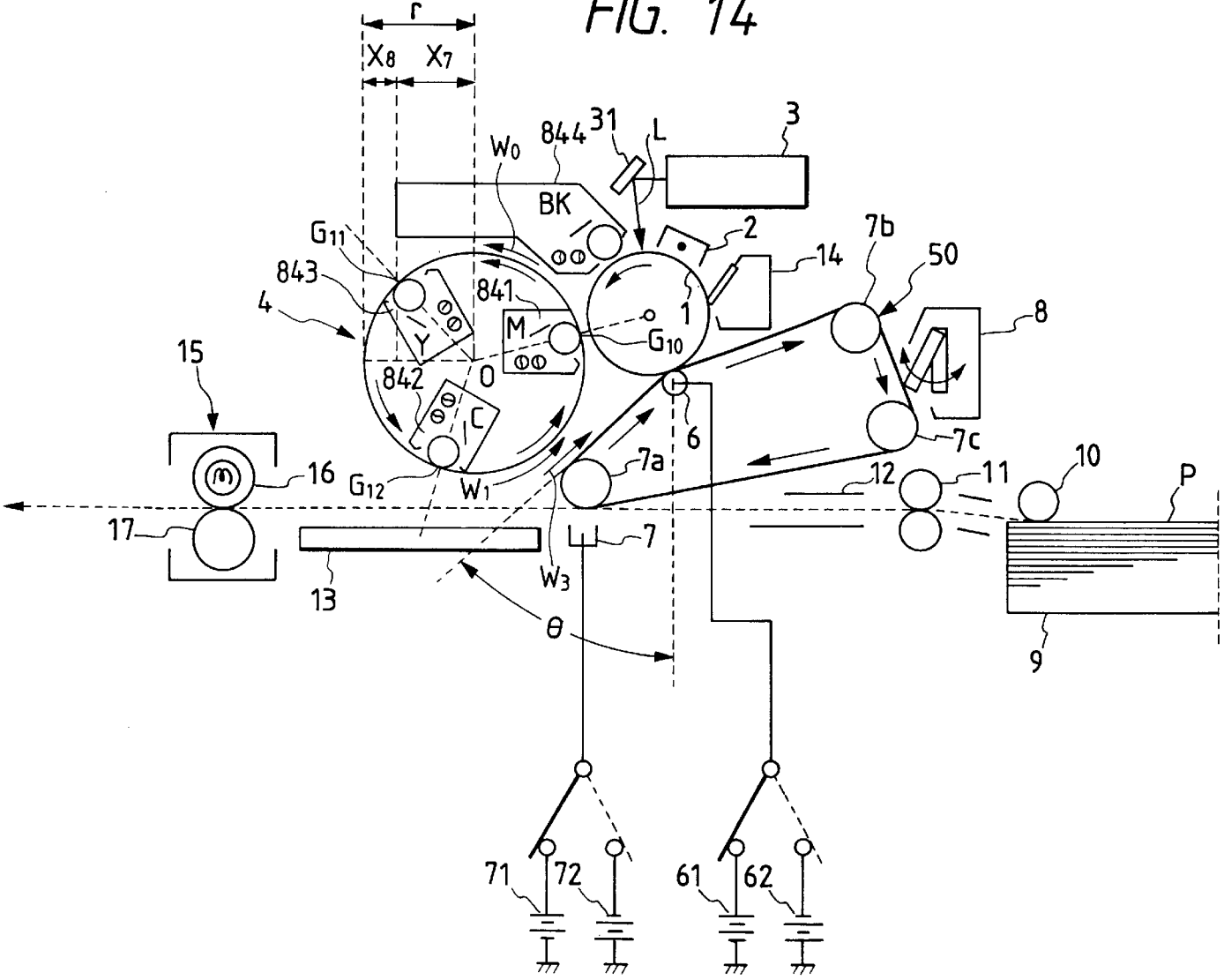
FIG. 14 is a schematic elevational sectional view showing a fourth alteration of the multi-color image forming apparatus of the ninth embodiment.

It is apparent that the theory of this embodiment can be used in place of the intermediate transfer drum 5 in the aforementioned embodiments. More particularly, in the alterations shown in FIGS. 11 to 14, regarding the construction other than the change between the intermediate transfer drum 5 and the intermediate transfer belt 50, FIG. 11 is the same as FIG. 1, FIG. 12 is the same as FIG. 4, FIG. 13 is the same as FIG. 5, and FIG. 14 is the same as FIG. 8.

Incidentally, it should be noted that the intermediate transfer drum 5 and the intermediate transfer belt 50 (as the intermediate transfer member) may be made of material other than the materials described above. Further, the BK developing device can be used regardless of the developing method. In addition, the transfer device 7 may comprise a transfer roller which can be contacted with and separated from the intermediate transfer member. Furthermore, the charge device may be a charge roller of a contact type.

While the present invention was explained in connection with specific embodiments, the present invention is not limited to such embodiment, but, various alterations and modifications can be adopted within the scope of the present invention.

What is claimed is:

1. An image forming apparatus comprising:

an optical system for projecting an image;

an image bearing member on which the image is projected by said optical system;

a rotatable first developing means having a plurality of developing devices for developing an image on said image bearing member at a first developing station; and a fixed second developing means having a single developing device arranged adjacent to said first developing means for developing an image on said image bearing member at a second developing station different from the first developing station, wherein said image bearing member moves in a direction from said second developing means to said first developing means, and first developing means rotates in an opposite direction to said image bearing member at an opposed position thereto, to prevent a toner in said first developing means from scattering toward said optical system.

2. An image forming apparatus according to claim 1, wherein said image bearing member is rotatable, and wherein it further comprises a transfer rotary member opposed to said rotatable first developing means and contacted with said image bearing member, said rotatable first developing means and said transfer rotary member being rotated in the same circumferential direction at an area where said rotatable first developing means and said transfer rotary member are opposed to each other.

3. An image forming apparatus according to claim 2, wherein an image formed on said image bearing member is transferred onto said transfer rotary member, and then is transferred from said transfer rotary member onto a transfer material.

4. An image forming apparatus according to claim 2, wherein a contact surface of said transfer rotary member starting to be contacted with said image bearing member is positioned nearer to said first developing means than a normal line passing through a contact area between said transfer rotary member and said image bearing member.

5. An image forming apparatus according to claim 2, wherein a diameter of said transfer rotary member is 160 mm or more.

6. An image forming apparatus according to claim 1 or 2, wherein said second developing means develops said image bearing member using a black toner.

7. An image forming apparatus according to claim 6, wherein said plurality of developing devices develop said image bearing member using different color toners, respectively.

8. An image forming apparatus according to claim 6, wherein when a first one of said plurality of developing devices is positioned at said first developing station, a second one of said plurality of developing devices is positioned on or above a horizontal line passing through a rotation axis of said first developing means, and a housing of the second developing means is provided at a position spaced apart from the rotation axis and away from said image bearing member and extending further than a development operating portion of the second one of the plurality of developing devices.

9. An image forming apparatus according to claim 6, wherein a length of said second developing means is greater than a length of said first developing means in a direction of the rotation axis.

10. An image forming apparatus according to claim 1, wherein a housing is provided on a lower surface of said second developing means.

11. An image forming apparatus according to claim 1 or 2, wherein when a first one of said plurality of developing devices is positioned at said first developing station, a second one of said plurality of developing devices is positioned on or above a horizontal line passing through a rotation axis of said first developing means, and a housing of the second developing means is provided at a position spaced apart from the rotation axis and away from said image bearing member and extending further than a development operation portion of the second one of the plurality of developing devices.

12. An image forming apparatus according to claim 1 or 2, wherein a length of said second developing means is greater than a length of said first developing means in a direction of the rotation axis.

13. An image forming apparatus according to claim 1, wherein said plurality of developing devices develop an image on said image bearing member using non-magnetic one-component developer.

14. An image forming apparatus according to claim 1, wherein said plurality of developing devices are equidistantly arranged in a circumferential direction around said rotation axis.

15. An image forming apparatus according to claim 1, wherein said image bearing member is a photosensitive drum.

16. An image forming apparatus according to claim 1, wherein said optical system and said first developing means are separated by said second developing means and said image bearing member, and said second developing means has a housing covering said first developing means.

17. An image forming apparatus according to claim 1, wherein the image is formed on an original.

18. An image forming apparatus according to claim 1, wherein the image is projected by a laser scanner for outputting a laser beam.

19. An image forming apparatus comprising:

an optical system for projecting an image;

an image bearing member on which the image is projected by said optical system;

a rotatable first developing means having a plurality of developing devices for developing said image bearing member at a first developing station; and a fixed second developing means having a single developing device arranged adjacent to said first developing means for developing said image bearing member at a second developing station different from the first developing station, said second developing means having a housing covering said first developing means;

wherein said optical system and said first developing means are adjacent to, and separated by, said second developing means and said image bearing member, and wherein when a first one of the plurality of developing devices of said first developing means is positioned at the first developing station, a second one of the plurality of developing devices is positioned on or above a horizontal line passing through a rotation axis of said first developing means, and the housing of said second developing means is provided at a position spaced apart from the rotation axis and away from said image bearing member and extending further than a development operating portion of the second one of the plurality of developing devices, and wherein said image bearing member moves in a direction from said second developing means to said first developing means, and first developing means rotates in an opposite direction to said image bearing member at an opposed position thereto, to prevent a toner in said first developing means from scattering toward said optical system.

20. An image forming apparatus according to claim 19, wherein said image bearing member is rotatable, and wherein it further comprises a transfer rotary member opposed to said first developing means and contacted with said image bearing member, said first developing means and said transfer rotary member being rotated in the same circumferential direction at an area where said first developing means and said transfer rotary member are opposed to each other.

21. An image forming apparatus according to claim 20, wherein an image formed on said image bearing member is transferred onto said transfer rotary member, and then is transferred from said transfer rotary member onto a transfer material.

22. An image forming apparatus according to claim 20, wherein a contact surface of said transfer rotary member starting to be contacted with said image bearing member is positioned nearer said first developing means than a normal line passing through a contact area between said transfer rotary member and said image bearing member.

23. An image forming apparatus according to claim 20, wherein a diameter of said transfer rotary member is 160 mm or more.

24. An image forming apparatus according to claim 19 or 20, wherein said second developing means develops said image bearing member using black toner.

25. An image forming apparatus according to claim 24, wherein said plurality of developing devices develop said image bearing member using different color toners, respectively.

26. An image forming apparatus according to claim 24, wherein a length of said second developing means is greater than a length of said first developing means in a direction of the rotation axis.

27. An image forming apparatus according to claim 19, wherein the cover portion is provided on a lower portion of said second developing means.

28. An image forming apparatus according to claim 19, or 20, wherein a length of said second developing means is greater than a length of said first developing means in a direction of the rotation axis.

29. An image forming apparatus according to claim 19, wherein said plurality of developing devices develop an image on said image bearing member using non-magnetic one-component developer.

30. An image forming apparatus according to claim 19, wherein said plurality of developing devices are equidistantly arranged in a circumferential direction around said rotation axis.

31. An image forming apparatus according to claim 19, wherein said image bearing member is a photosensitive drum.

32. An image forming apparatus according to claim 19, wherein the image is formed on an original.

33. An image forming apparatus according to claim 19, wherein the image is projected by a laser scanner for outputting a laser beam.

* * * * *

UNITED STATES PATENT AND TRADEMARK OFFICE

CERTIFICATE OF CORRECTION

PATENT NO. : 6,047,149
DATED : April 4, 2000
INVENTOR(S) : Katsuhiko Hashimura, et al.

It is certified that error appears in the above-identified patent and that said Letters Patent is hereby corrected as shown below:

COLUMN 7
Line 33, "On" should read --¶On--; and
Line 50, "t he" should read --the--.

COLUMN 8
Line 29, "radium" should read --radius--.

COLUMN 10
Line 12, "calory" should read --temperature--; and
Line 17, "polyorefin" should read --polyolefin--

COLUMN 13
Line 45, "small" should read --small amount--.

COLUMN 20
Line 6, "claim 19," should read --claim 19--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*